US008978536B2

(12) United States Patent
Dodworth

(10) Patent No.: US 8,978,536 B2
(45) Date of Patent: Mar. 17, 2015

(54) MATERIAL FOR PROVIDING BLAST AND PROJECTILE IMPACT PROTECTION

(75) Inventor: Antony Dodworth, Tallington Stamford (GB)

(73) Assignee: Future Force Innovation, Inc., New York, NY (US)

( * ) Notice: Subject to any disclaimer, the term of this patent is extended or adjusted under 35 U.S.C. 154(b) by 389 days.

(21) Appl. No.: 13/459,476

(22) Filed: Apr. 30, 2012

(65) Prior Publication Data

US 2013/0284003 A1 Oct. 31, 2013

(51) Int. Cl.
*F41H 5/04* (2006.01)
*F41H 7/04* (2006.01)

(52) U.S. Cl.
CPC ..... *F41H 5/0492* (2013.01); *F41H 7/044* (2013.01)
USPC ..... 89/36.02; 296/187.07

(58) Field of Classification Search
CPC ..... F41H 5/0492; F41H 7/044
USPC ..... 89/36.02, 36.11, 36.12; 114/9–15; 296/187.07
See application file for complete search history.

(56) References Cited

U.S. PATENT DOCUMENTS

| | | | | |
|---|---|---|---|---|
| 3,924,038 | A | 12/1975 | McArdle et al. | |
| 4,529,640 | A | 7/1985 | Brown et al. | |
| 4,928,575 | A | 5/1990 | Smirlock et al. | |
| 5,170,690 | A | 12/1992 | Smirlock et al. | |
| 5,191,166 | A | 3/1993 | Smirlock et al. | |
| 5,200,256 | A | 4/1993 | Dunbar | |
| 5,333,532 | A | 8/1994 | Smirlock et al. | |
| 5,349,893 | A * | 9/1994 | Dunn | 89/36.05 |
| 5,534,343 | A | 7/1996 | Landi et al. | |
| 6,216,579 | B1 | 4/2001 | Boos et al. | |
| 6,481,259 | B1 | 11/2002 | Durney | |
| 6,497,966 | B2 | 12/2002 | Cohen | |
| 6,601,497 | B2 | 8/2003 | Ghiorse et al. | |
| 6,640,605 | B2 | 11/2003 | Gitlin et al. | |
| 6,792,843 | B2 | 9/2004 | Mohr et al. | |
| 6,825,137 | B2 | 11/2004 | Fu et al. | |
| 6,912,944 | B2 | 7/2005 | Lucuta et al. | |
| 7,490,539 | B2 | 2/2009 | Ma | |
| 7,546,796 | B2 | 6/2009 | Hunn | |
| 7,628,104 | B2 | 12/2009 | Warren et al. | |
| 8,096,223 | B1 | 1/2012 | Andrews | |

(Continued)

FOREIGN PATENT DOCUMENTS

| | | | |
|---|---|---|---|
| DE | 4005904 | A1 | 8/1991 |
| DE | 3924267 | C1 | 12/1994 |

(Continued)

OTHER PUBLICATIONS

Luchoo et al., "Macro-Scale Modelling of Discontinuous Fibre Composites," 18th International Conference on Composite Materials (Aug. 21-26 2011), Jeju Island, Korea, Jul. 2011.

*Primary Examiner* — Glenn Dayoan
*Assistant Examiner* — Melissa A Black
(74) *Attorney, Agent, or Firm* — Covington & Burling LLP; Andrea G. Reister

(57) ABSTRACT

A multi-layer material that provides blast and projectile impact protection is provided. The multi-layer material may include a hard metal layer, a composite layer, an air gap layer, and an innermost layer. An armor layer may also be provided that includes a polymeric honeycomb layer and a ceramic layer. In other aspects of the invention, a vehicle made from the multi-layer material is provided, and methods for making the multi-layer material are provided.

64 Claims, 15 Drawing Sheets

(56) References Cited

U.S. PATENT DOCUMENTS

| | | | |
|---|---|---|---|
| 2007/0180982 | A1 | 8/2007 | Dagher et al. |
| 2008/0006145 | A1 | 1/2008 | Park et al. |
| 2010/0043630 | A1 | 2/2010 | Sayre et al. |
| 2010/0083819 | A1 | 4/2010 | Mann et al. |
| 2010/0098944 | A1 | 4/2010 | Dodworth |
| 2010/0101402 | A1 | 4/2010 | Ma |
| 2010/0116795 | A1 | 5/2010 | Dodworth |
| 2010/0275765 | A1 | 11/2010 | Lagrotta et al. |
| 2010/0313744 | A1 | 12/2010 | Hansen et al. |
| 2011/0107904 | A1 | 5/2011 | Queheillalt et al. |
| 2011/0192274 | A1 | 8/2011 | Fingerhut |
| 2011/0214560 | A1 | 9/2011 | Skertchly |
| 2011/0239851 | A1 | 10/2011 | Mason et al. |
| 2011/0283873 | A1 | 11/2011 | Wadley et al. |
| 2012/0009400 | A1* | 1/2012 | Nauer et al. ..... 428/215 |

FOREIGN PATENT DOCUMENTS

| | | | |
|---|---|---|---|
| EP | 0237095 | A1 | 9/1987 |
| WO | WO-2004022868 | A2 | 3/2004 |

* cited by examiner

MATERIAL FOR PROVIDING BLAST AND PROJECTILE IMPACT PROTECTION

FIELD OF THE INVENTION

Embodiments of the present invention generally relate to a multi-layer material that provides blast and projectile impact protection. Other embodiments of the invention relate to vehicles made from such material, and methods for making the material.

BACKGROUND OF THE INVENTION

The need to provide blast and projectile impact protection for military, security, and police forces is well known. Military personnel need lightweight, fast, and maneuverable vehicles, but the vehicle occupants also need to be protected to the maximum extent possible. Conventional materials that provide structural support for a vehicle, as well as some measure of ballistic protection, include metals such as Rolled Homogeneous Armor (RHA) steel and aluminum, for example AL 7039. Such materials are not optimal for making a vehicle body, hull, fuselage or the like that is lightweight, an important military requirement with respect to transport, operability and lifecycle costs of military vehicles. Vehicles made from such materials become even heavier when augmented with further survivability enhancement systems such as ceramic tiles applied to the outer surface.

Lightweight materials that can provide protection from ballistic projectiles include fibers layered with thermoplastic resins, such as polypropylene and polyethylene, and the like. Such fibers include E-glass and S-glass fibers, woven KEVLAR®, such as K760 or Hexform®, manufactured by Hexcel Corporation, non-woven Kevlar® fabric, manufactured by Polystrand Corporation. A significant drawback of such materials for military vehicles is cost—although fiber-reinforced plastic materials are lightweight, the unit cost tends to be significantly higher than heavier alternatives such as steel.

Thus, there is a need in the art for a lightweight and cost effective material that can provide both structural support for a vehicle, as well as blast and projectile impact protection.

BRIEF SUMMARY OF THE INVENTION

In one aspect, the present invention provides a multi-layer material that provides blast and projectile impact protection. The multi-layer material may comprise two sub-layers. One of the sub-layers may comprise a hard metal layer, a composite layer, an air gap layer, and an innermost layer. The hard metal layer is preferably a steel layer, and the innermost layer is preferably selected from aramid fibers, aromatic polyamide fibers, and ultra-high molecular weight polyethylene. The other sub-layer may preferably comprise a polymeric honeycomb layer and an outermost layer. The outermost layer may comprise ceramic tiles.

In another aspect, the present invention provides a multi-layer material for a vehicle body or hull, vessel hull, or aircraft fuselage, that provides blast and projectile impact protection. The multi-layer material may comprise an outermost layer comprising ceramic tiles, the outermost layer including an impact receiving side and an inner side, wherein a projectile impacting the multi-layer material proceeds from the impact receiving side of the outermost layer in an inward direction toward the inner side; an innermost layer comprising ballistic material selected from the group consisting of aramid fibers, aromatic polyamide fibers and ultra-high molecular weight polyethylene, the innermost layer being spaced apart inwardly from the inner side of the outermost layer; a polymeric honeycomb layer; a steel layer; a composite layer comprising carbon fiber and glass fiber, wherein the composite layer has a non-uniform fiber fraction; and an air gap layer disposed between the innermost layer and the composite layer, wherein the steel layer is disposed between the composite layer and the polymeric honeycomb layer and the polymeric honeycomb layer is disposed between the steel layer and the inner side of the outermost layer.

In another aspect, the present invention provides a vehicle made from the multi-layer material of the present invention. The vehicle may comprise a vehicle body that mitigates blast pressure and resists projectile penetration. The vehicle body may comprise a steel layer; a composite layer comprising carbon fiber and glass fiber, wherein the composite layer has a non-uniform fiber fraction; an innermost layer comprising ballistic material selected from the group consisting of aramid fibers, aromatic polyamide fibers and ultra-high molecular weight polyethylene; and an air gap layer disposed between the innermost layer and the composite layer, wherein the composite layer is disposed between the steel layer and the innermost layer.

The vehicle may further comprise an armor layer disposed on the vehicle body. The armor layer may comprise an outermost layer comprising ceramic tiles, wherein the outermost layer includes an impact receiving side and an inner side, wherein a projectile impacting the vehicle proceeds from the impact receiving side of the outermost layer in an inward direction toward the inner side, and a polymeric honeycomb layer disposed between the steel layer and the inner side of the outermost layer.

In another aspect of the invention, a method of making a composite preform using a plurality of fiber types is provided. The method comprises applying an epoxy to elongate lengths of at least one fiber type; cutting the elongate lengths of the at least one fiber type and elongate lengths of others of the plurality of fiber types into shorter lengths of fiber to form a charge, wherein the applying step is carried out just prior to the cutting step; removing at least a portion of air entrapped in the charge; and heating the charge to form a composite preform, wherein the composite preform has a non-uniform fiber fraction. The step of removing at least a portion of air entrapped in the charge may comprise applying a vacuum, and may comprise compressing the charge. The cutting step may be carried out so that at least a portion of the shorter lengths of fiber in the charge are aligned. The cutting step may be carried out so that an arrangement of the shorter lengths of fiber in the charge is random.

The composite preform may be cured in a subsequent curing step. In a further aspect of the invention, the curing step is carried out during assembly of the final structure being made, such as during assembly of a vehicle body. A further aspect of the invention is the composite preform made in accordance with the methods described in the present application.

In a further aspect of the present invention, a method for assembling a vehicle body or portion thereof is provided. The method comprises applying a plasma coating to one side of each of a plurality of steel panels to form a plurality of plasma coated steel panels; welding together less than all of the plurality of plasma coated steel panels to form a steel shell with an opening; applying a contact adhesive to an interior surface of the steel shell; contacting a plurality of composite preforms to the contact adhesive to thereby adhere the plurality of composite preforms to the interior surface of the steel shell, wherein each of the plurality of composite preforms comprises an epoxy and a plurality of fiber types and has a non-uniform fiber fraction; inserting a film into the steel shell; applying a vacuum to remove air between the film and the plurality of composite preforms to form a composite adhered steel shell; and heating the composite adhered steel shell in an oven to thereby cure the composite preforms. In a further aspect of the present invention, the method further comprises applying paint to the composite adhered steel shell during the step of heating the composite adhered steel shell in the oven. In still a further aspect of the present invention, the method further comprises subsequent to the contacting step, welding the remaining one or more of the plurality of plasma coated steel panels to the steel shell to thereby close the opening. In still a further aspect of the present invention, each of the plurality of the composite preforms is produced by a method that comprises applying an epoxy to elongate lengths of at least one fiber type; cutting the elongate lengths of the at least one fiber type and elongate lengths of others of the plurality of fiber types into shorter lengths of fiber to form a charge, wherein the applying step is carried out just prior to the cutting step; removing at least a portion of air entrapped in the charge; and heating the charge to form a composite preform, wherein the composite preform has a non-uniform fiber fraction.

In yet another aspect, the present invention provides a method of forming a three-dimensional metal structure. The method may comprise forming a plurality of slots in a portion of a sheet of metal material, wherein the plurality of slots do not completely penetrate a thickness of the sheet, the plurality of slots forming a plurality of straps of solid metal material interposed between adjacent ones of the plurality of slots; and folding the portion of the sheet along a fold line, wherein the fold line is not perpendicular to the plurality of straps, and wherein the fold line is not parallel to the plurality of slots. The sheet may be formed from bainite steel. The thickness of each of the plurality of straps may be constant across the sheet of metal material. At least one of the plurality of slots may cross the fold line. In one aspect, the fold line forms an angle with the plurality of straps in the range of from about 35° to about 45°. In yet a further aspect, the sheet is formed from bainite steel and the angle is about 35°. In still a further aspect, the sheet is formed from aluminum and the angle is about 45°.

In yet a further aspect of the present invention, a method of forming a three-dimensional metal structure is provided. The method may comprise forming a first plurality of slots in a first portion of a sheet of metal material, wherein the first plurality of slots do not completely penetrate a thickness of the sheet, the first plurality of slots forming a first plurality of straps interposed between adjacent ones of the first plurality of slots; forming a second plurality of slots in a second portion of the sheet of metal material, wherein the second plurality of slots do not completely penetrate the thickness of the sheet, the second plurality of slots forming a second plurality of straps interposed between adjacent ones of the second plurality of slots; folding the first portion toward the second portion along a first fold line, wherein the first fold line is not perpendicular to the first plurality of straps, and wherein the first fold line is not parallel to the first plurality of slots; folding the second portion toward the first portion along a second fold line, wherein the second fold line is not perpendicular to the second plurality of straps, and wherein the second fold line is not parallel to the second plurality of slots. In a further aspect of the invention, at least one of the first plurality of slots crosses the first fold line, and at least one of the second plurality of slots crosses the second fold line. In a further aspect of the invention, the sheet is formed from bainite steel.

DETAILED DESCRIPTION OF THE INVENTION

Embodiments of the present invention generally relate to material that provides blast and projectile impact protection. Other embodiments of the invention relate to vehicles made from such material, and methods for making the material. The multi-layer material of the present invention advantageously provides a lightweight and cost effective material that can provide both structural support for a vehicle, as well as blast and projectile impact protection. As described in more detail below, the use of the composite material of the present invention in conjunction with a layer of hard metal such as bainite steel advantageously provides a multi-layer structural and ballistic protection material significantly lighter in weight, on the order of one-half of the weight of conventional structural and ballistic panels for a given threat level. The multi-layer material of the present invention advantageously provides structural and ballistic protection significantly lighter in weight than both conventional steel and aluminum solutions, providing a weight savings on the order of 40-50% without sacrificing ballistic protection.

Figure 1:
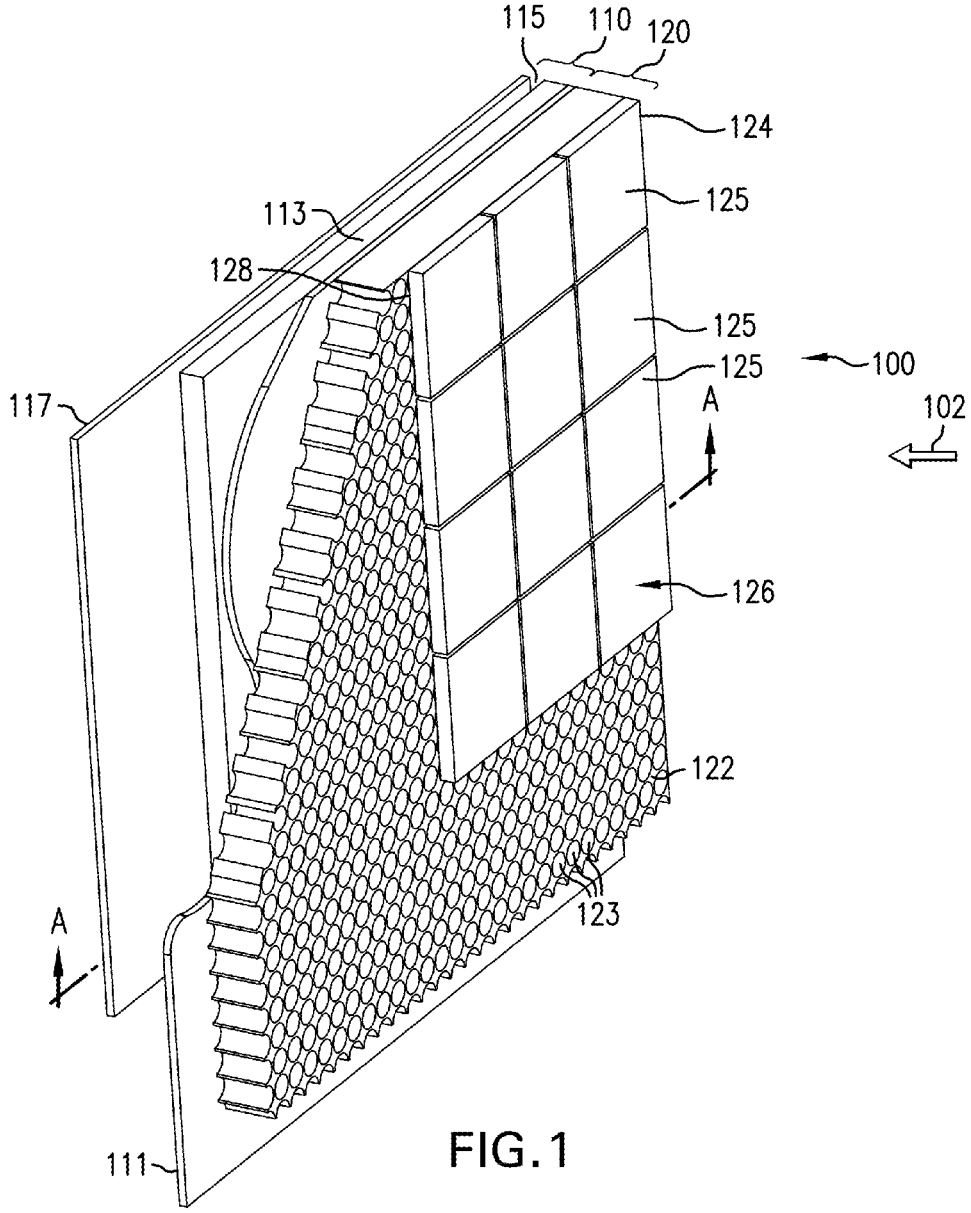
FIG. 1 is an isometric view of one embodiment of a multi-layer material of the present invention.
Figure 2:
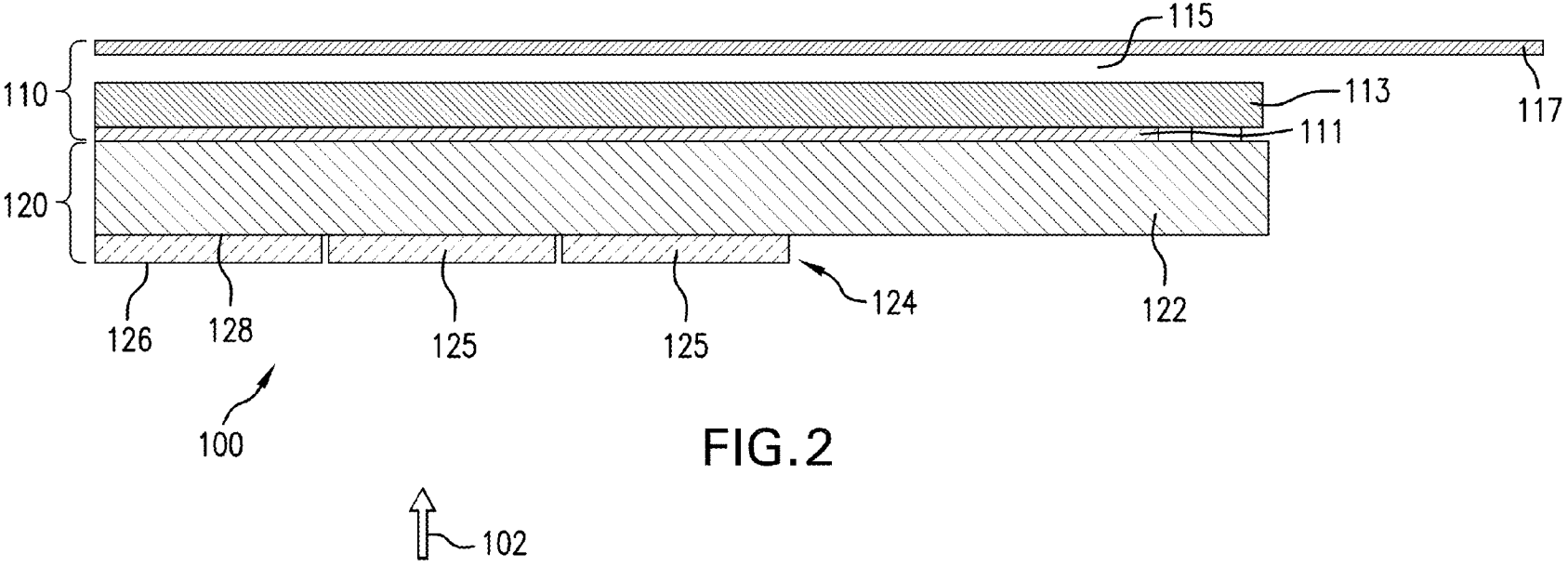
FIG. 2 is a cross-sectional view along line A-A of the embodiment shown in FIG. 1.

An isometric view of one embodiment of a multi-layer material 100 of the present invention is shown in FIG. 1, and a cross-sectional view along line A-A is shown in FIG. 2. Multi-layer material 100 of the present invention may comprise two sub-layers, sub-layer 110 and sub-layer 120. As explained in more detail below, sub-layer 110 may comprise a hard metal layer 111, a composite layer 113, an air gap layer 115, and an innermost layer 117. Sub-layer 120 may comprise a polymeric honeycomb layer 122 and an outermost layer 124. As shown in FIG. 1, arrow 102 indicates a direction of impact from a projectile, such as a ballistic projectile. Outermost layer 124 comprises an impact receiving side 126 that faces the direction of impact, and an inner side 128. A projectile impacting multi-layer material 100 proceeds from impact receiving side 126 of outermost layer 124 in an inward direction toward inner side 128.

As illustrated in FIGS. 1 and 2, sub-layer 110 comprises a hard metal layer 111. Hard metal layer 111 is preferably a steel layer. A preferred type of steel is bainite steel having a bainite microstructure, such as Flash Bainite 4130 described at www.bainitesteel.com, and available through Sirius Protection, LLC, Washington Twp., Mich. Other types of steel that may be used include high strength steel, high hard steel, high hard Military steel, and RHA (Rolled Homogeneous Armor) steel. A bainite steel is preferred because of its superior material properties (higher tensile strength with good ductility and toughness) and for the same ballistic performance can be thinner, and, therefore, lighter. In one preferred embodiment, hard metal layer 111 is a bainite steel layer that is about 4 to about 6 mm in thickness.

Figure 4:
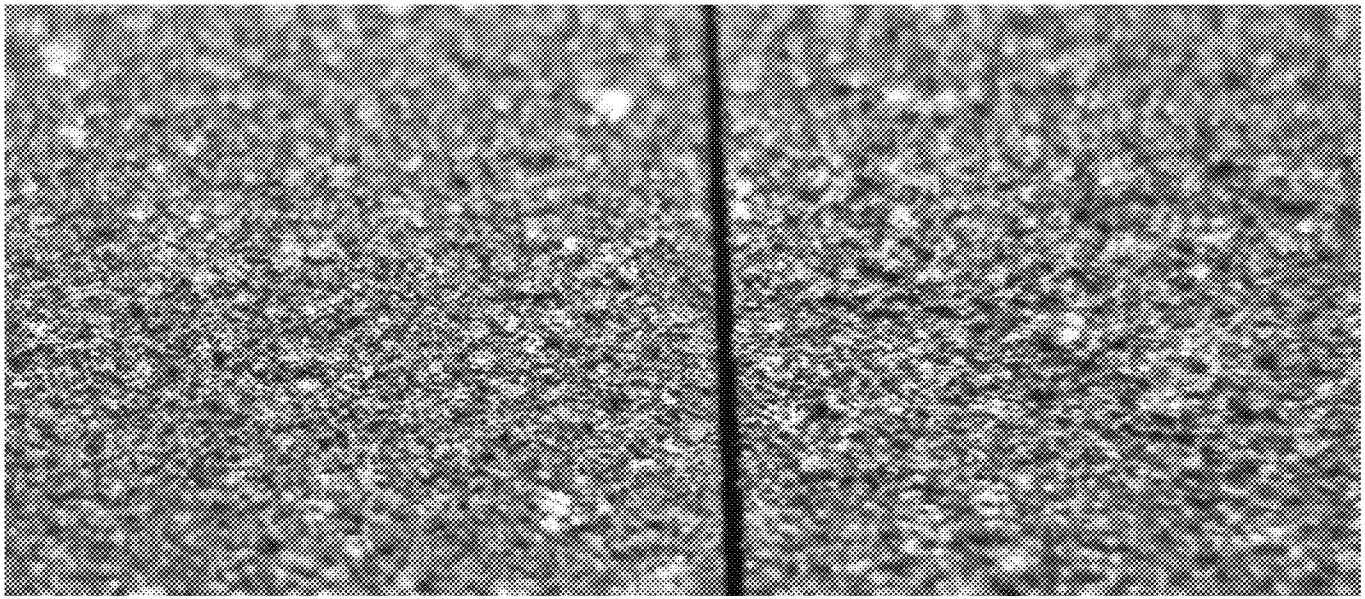
FIG. 4 is a detailed view of one embodiment of a spray coat applied to a hard metal layer of a multi-layer material of the present invention.

In a preferred embodiment, a side of hard metal layer 111 is plasma coated to provide texture, like a sand paper type surface, to improve the bonding of composite layer 113 to hard metal layer 111. The plasma coating is preferably disposed on a side of hard metal layer 111 facing composite layer 113. FIG. 4 illustrates a photograph of a plasma coating 411 applied to a steel layer, such as hard metal layer 111. As would be understood by one skilled in the art, plasma coating 411 (which may be referred to herein as a "spray coat") is created by droplets of metal sprayed at hard metal layer 111. The spray coat or plasma material is preferably aluminum or stainless steel, and is approximately 60 microns thick. The spray coat can be applied by conventional spray coating techniques known to one skilled in the art. Plasma coating 411 improves the bonding of composite layer 113 to hard metal layer 111 so that, for example, as a steel layer returns to shape after impact by a projectile, the composite returns to shape with it, rather than delaminating. As would be readily apparent to one skilled in the art, plasma coating 411 may be of different levels of coarseness, with various grades of roughness, such as 60 grit sandpaper or other texture grades or roughness. Applying plasma coating 411 also advantageously burns off any contaminants from the steel, such as oil or slag.

Composite layer 113 is preferably a composite formed from a plurality of fiber types and an epoxy. In a preferred embodiment, the plurality of fiber types comprises carbon fiber and glass fiber. As known to one skilled in the art, epoxy, also known as polyepoxide, is a thermosetting polymer formed from reaction of an epoxide "resin" with polyamine "hardener." A preferred method of making composite layer 113 is described in more detail below. As described in more detail below, composite layer 113 preferably has a non-uniform fiber fraction. In one preferred embodiment, composite layer 113 is about 19 mm in thickness. As explained in more detail below with respect to assembly of a vehicle body and in conjunction with FIG. 11, composite layer 113 is processed under vacuum against plasma coating 411; heat is applied while under vacuum that causes the resin to flow, thereby wetting out the fibers and plasma coating 411, causing the resin to flow into the plasma coating. As the resin cures, it forms a permanent bond between composite layer 113 and plasma coating 411.

On a weight basis, composite layer 113 may be divided into two portions—one portion where the weight is attributable to the fibers (a fiber portion) and a second portion where the weight is attributable to the epoxy or resin (a resin portion). In one embodiment, the fiber portion of composite layer 113 is 50% by weight carbon fiber and 50% by weight glass fiber, or in other words, a weight ratio of carbon fiber to glass fiber of 1:1. In another embodiment, the fiber portion of composite layer 113 is 40% by weight carbon fiber and 60% by weight glass fiber, or in other words, a weight ratio of carbon fiber to glass fiber of 1:1.5. As would be readily apparent to one skilled in the art, other weight ratios of carbon fiber to glass fiber could be used in composite layer 113. In one embodiment, ceramic flakes, such as irregularly shaped platelets or flakes, are provided near or at the surface of composite layer 113 facing air gap layer 115 to increase the surface area through which the projectile or ballistic round will have to travel, to change the direction of travel of the projectile or round, and to provide a larger area of delamination in which energy is absorbed by allowing micro-cracks in the resin and stretching of the fibers.

In one embodiment of the present invention, the fiber portion of composite layer 113 is approximately ⅔ by weight and the epoxy or resin portion is approximately ⅓ by weight. In such an embodiment, a composite layer having a fiber portion that is 50% by weight carbon fiber and 50% by weight glass fiber will be approximately ⅓ by weight carbon fiber, ⅓ by weight glass fiber, and ⅓ by weight epoxy. Generally, the "drier" the composite material (drier referring to lower resin content), the better the ballistic performance because more fibers can move and stretch as there is less resin present to hold the fiber in place. Composite layer 113 has to have enough resin to keep its structural integrity, and a lower limit on the percent by weight of the resin portion of composite layer 113 is on the order of about 23%.

Innermost layer 117 is spaced apart from outermost layer 124 in an inward direction, that is, proceeding in the direction of impact 102. It is desirable for innermost layer 117 to exhibit high strain to failure, allowing the material to stretch and absorb energy, to be low weight and moisture resistant. Innermost layer 117 preferably functions as a spall liner for providing ballistic protection. Innermost layer 117 is preferably formed from ballistic material that may include plies of aramid or aromatic polyamide fibers such as KEVLAR® aramid consolidated within a thermoset or thermoplastic material. Innermost layer 117 may also be high performance and high modulus polyethylene such as DYNEEMA® or Spectra Shield®, or other high strength ballistic fiber material in consolidated or unconsolidated (soft) form. Innermost layer 117 preferably comprises ultra-high molecular weight polyethylene (UHMwPE), which may be in the form of fibers. A preferred type of UHMwPE is DYNEEMA®, available from DSM and described at www.dyneema.com. The UHMwPE may be pressed into a sheet or molded into soft shapes. Alternatively, innermost layer 117 may be made from aramid fibers, such as KEVLAR® aramid fibers available from DuPont, which may also be pressed into a sheet or molded into soft shapes. In one preferred embodiment, innermost layer 117 is about 6 mm in thickness.

In the embodiment illustrated in FIGS. 1 and 2, air gap layer 115 is disposed between innermost layer 117 and composite layer 113. As will be explained in more detail below, air gap layer 115 advantageously improves resistance to projectile penetration by providing space into which any delamination of composite layer 113 can move. In one preferred embodiment, air gap layer 115 is about 12 mm in thickness. In alternative embodiments of the multi-layer material of the present invention, air gap layer 115 is omitted. Air gap layer 115 provides space in which the round or projectile can tumble, thereby increasing the surface area of the round or projectile that impacts innermost layer 117.

Figure 3:
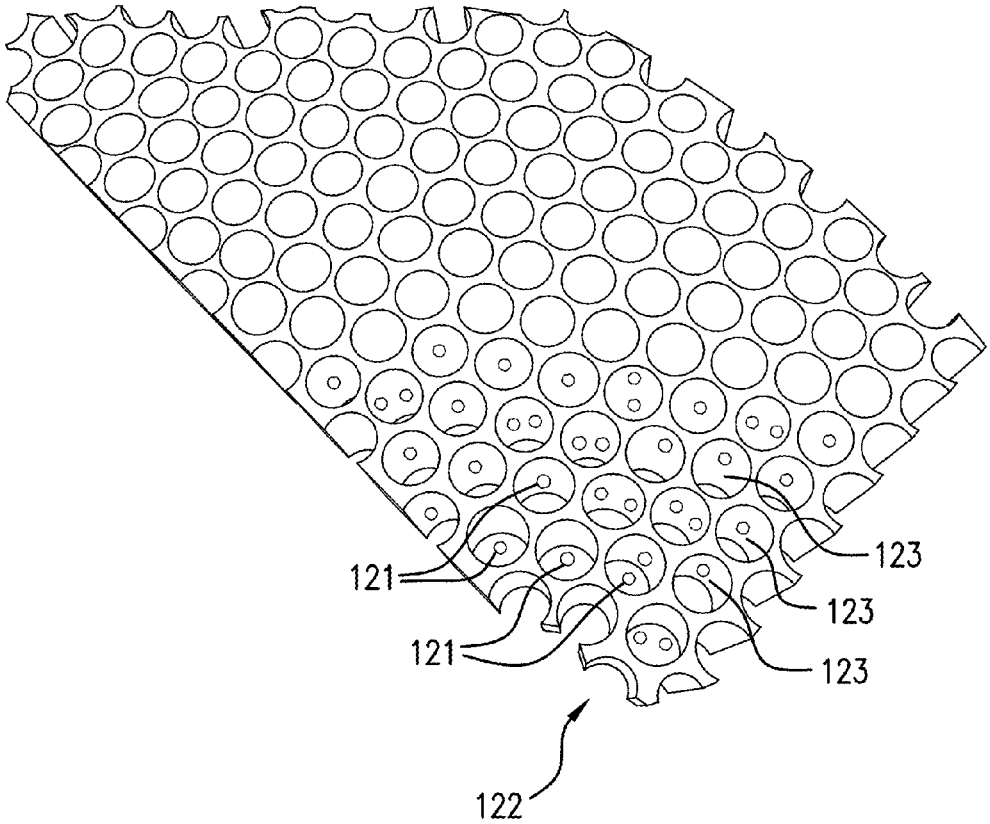
FIG. 3 is a detailed view of one embodiment of a polymeric honeycomb layer of a multi-layer material of the present invention.

As illustrated in FIGS. 1 and 2, sub-layer 120 comprises a polymeric honeycomb layer 122 and an outermost layer 124. As discussed in more detail below, sub-layer 120 may also be referred to as an armor layer. Outermost layer 124 is preferably a ceramic tile layer comprising a plurality of ceramic tiles 125. Ceramic tiles 125 are preferably made from silicon carbide, for example, Hexoloy® SA Silicon Carbide tiles available from Saint-Gobain Ceramics that provide high hardness and compressive strength, yet are light weight. In the embodiment illustrated in FIGS. 1 and 2, polymeric honeycomb layer 122 is disposed between hard metal layer 111 and inner side 128 of outermost layer 124. In an alternate embodiment, a second air gap layer may be disposed between hard metal layer 111 and polymeric honeycomb layer 122. Polymeric honeycomb layer 122 may be bonded to outermost layer 124 using, for example, a rubberized adhesive that will survive shock and rapidly changing temperatures, such as for example, the two-part Zyvex Epovex epoxy adhesive. The material for polymeric honeycomb layer should be stiff enough to prevent ceramic tiles 125 from cracking when subject to impact from a projectile. Moreover, polymeric honeycomb layer should provide space in which the projectile or round can tumble, thereby increasing the distance the projectile has to travel in order to penetrate the layer. In a preferred embodiment, polymeric honeycomb layer is made from polycarbonate or polyetherimide. As illustrated, for example, in FIGS. 1 and 3, polymeric honeycomb layer 122 comprises a plurality of individual cylindrically shaped voids or cells 123. Preferred polymeric honeycomb layers are available from Tubus Bauer as described at www.tubus-bauer-.com. As would be readily apparent to one skilled in the art, cell size and thickness play a role in selecting a material for polymeric honeycomb layer 122. Smaller cell size may provide a small increase in compressive strength of the layer without any increase in overall density, but performance when distorted or crushed should be considered. In one preferred embodiment, polymeric honeycomb layer 122 is about 40 mm in thickness, and cells 123 are 6 or 7 mm in diameter. In such an embodiment, outermost layer 124 is about 12 mm in thickness.

In one embodiment, ceramic pellets, such as balls, spheres, or other shapes, are included within polymeric honeycomb layer 122. As shown, for example, in FIG. 3, ceramic pellets 121 are disposed within cells 123. Pellets 121 may take on a variety of shapes, including square, rectangular, round, triangular, and include irregularly shaped pellets. Pellets 121 are advantageously provided in polymeric honeycomb layer 122 as they may function to turn projectiles or tumble the round reaching that layer, thereby increasing the distance the projectile has to travel in order to penetrate the layer.

In one preferred embodiment of the multi-layer material 100 illustrated in FIGS. 1 and 2, a thickness of a cross-section of all layers is less than about 100 mm, with innermost layer 117 being about 6 mm in thickness, air gap layer 115 being about 12 mm in thickness, composite layer 113 being about 19 mm in thickness, hard metal layer 111 being about 6 mm in thickness, polymeric honeycomb layer 122 being about 40 mm in thickness, and outermost layer 124 being about 12 mm in thickness.

The multi-layer material of the present invention advantageously provides both blast and projectile impact protection. In one embodiment of the invention, the multi-layer material is used for a vehicle body or hull, vessel hull, or aircraft fuselage, such as those used by the military, police, or security forces. A blast threat can be posed, for example, by a mine or an Improvised Explosive Device, while a projectile impact threat can be posed by ballistic ordnance, rounds, bullets and the like. In order to both mitigate blast pressure and resist projectile penetration, a material must exhibit both stiffness and hardness. In order to successfully mitigate blast pressure, as well as resist penetration by ballistic projectiles, the multi-layer material of the present invention was developed to achieve an estimated $V_{50}$ of 3500 ft./s (feet per second) for a 20 mm FSP (Fragment Simulation Projectile). As would be readily apparent to one skilled in the art, "$V_{50}$" refers to the velocity at which a specified projectile has a 50% chance of penetrating an armor panel.

Feasibility testing was conducted on samples of exemplary embodiments of the multi-layer material of the present invention to determine its ballistic performance. The testing included 20 mm FSP testing followed by small arms armor piercing (AP) rounds in conjunction with an armor layer. Sample panels were tested using a sub-layer 110 of a hard metal layer of Bainite Flash 4130 Steel supplied by Sirius Protection, LLC, a composite layer of 50% by weight carbon fiber and 50% by weight S-2 glass fiber having a non-uniform fiber fraction, no air gap layer, and an innermost layer of DYNEEMA® HB 80. The steel layer was bonded to the composite layer using Zyvex Epovex two-part epoxy adhesive. The 20 mm $V_{50}$ for a sample panel having a steel layer of ¼" and a composite layer ½" was 3616 ft./s. The 20 mm $V_{50}$ for a sample panel having a steel layer of 3/16" and a composite layer of 1" was 3589 ft./s.

Additional testing was conducted with an armor layer of Saint-Gobain Hexoloy® SA Silicon Carbide ceramic tiles bonded to a polymeric honeycomb layer as described above and shown in FIG. 3. The polymeric honeycomb layer was 19 mm in thickness, and was made from polycarbonate with 600 gm/m$^2$ of a 2×2 E-glass and 670 gm/m$^2$ of snap cure epoxy. The ceramic tiles were bonded to the polymeric honeycomb layer using Zyvex Epovex two-part epoxy adhesive. Two thicknesses (0.262" and 0.30") of ceramic tiles were tested. The armor layer was clamped over the sub-layer 110. The ¼" steel/½" composite layer panel was overlaid with a 5.13 psf (pounds per square foot) armor layer using the 0.262" ceramic tiles, and the armor piercing round fully penetrated the ceramic tiles, but did not penetrate the steel layer. The 3/16" steel/1" composite layer panel was overlaid with a 4.23 psf (pounds per square foot) armor layer using the 0.30" ceramic tiles, and the armor piercing round penetrated the ceramic tiles and the steel, and imbedded within the composite layer.

Figure 5A:
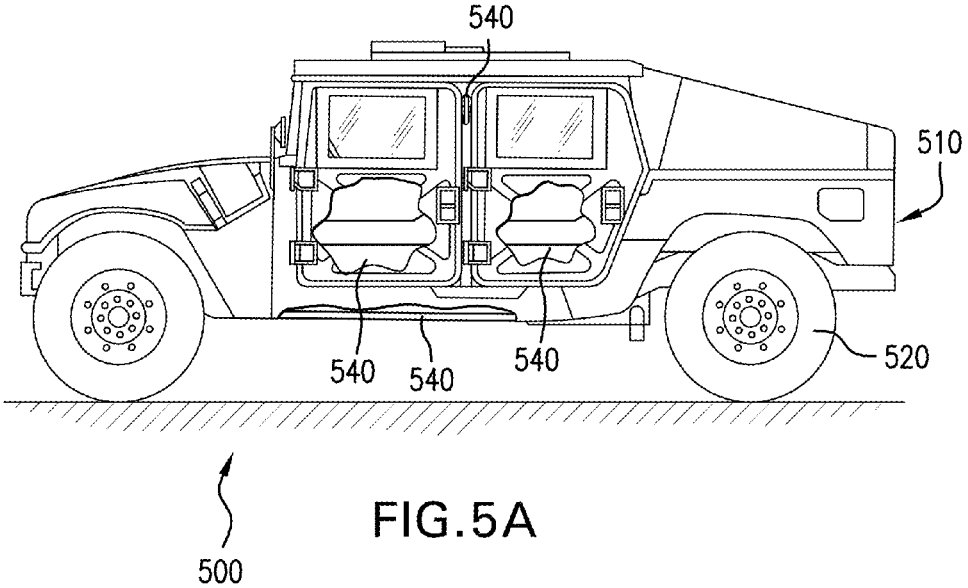
FIG. 5A is one embodiment of a wheeled vehicle made from a multi-layer material of the present invention.
Figure 5B:
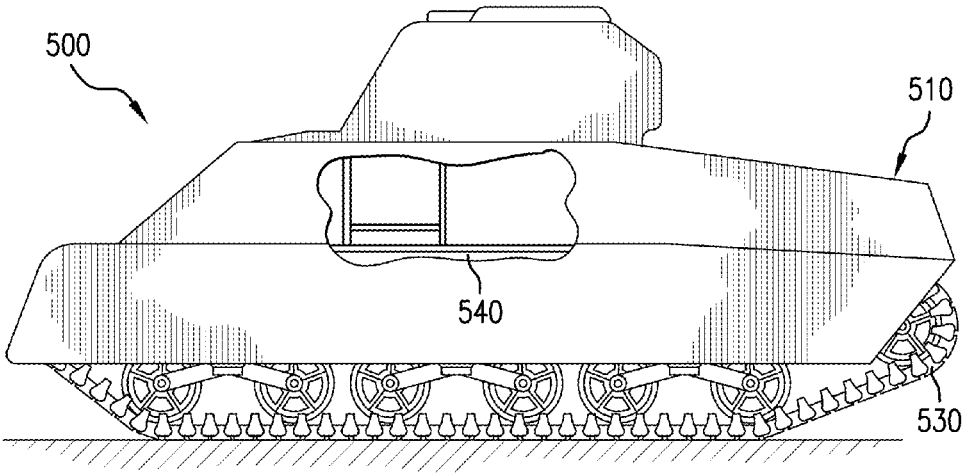
FIG. 5B is one embodiment of a tracked vehicle made from a multi-layer material of the present invention.

Multi-layer material 100 may be used in the construction of vehicles, particularly in the construction of vehicles subject to blast pressure and impact from ballistic projectiles, such as military, police, or security vehicles. Such vehicles include, but are not limited to, wheeled or tracked vehicles, vessels such as ships and boats, and aircraft. In one embodiment of the present invention, a vehicle is provided that comprises a vehicle body that mitigates blast pressure and resists projectile penetration. Exemplary vehicles are illustrated in FIGS. 5A and 5B. As shown in FIG. 5A, vehicle 500 includes a vehicle body 510 and a plurality of wheels 520. Preferably vehicle body 510 is made from sub-layer 110 as described in detail above. Vehicle 500 may also comprise an armor layer, such as sub-layer 120 as described in detail above. As would be apparent to one skilled in the art, such an armor layer for a military vehicle may be referred to as a "B-Kit." Another exemplary vehicle is illustrated in FIG. 5B. Vehicle 500 shown in FIG. 5B also preferably includes a vehicle body 510 made from sub-layer 110, and may also include an armor layer such as sub-layer 120. The embodiment shown in FIG. 5B is a tracked vehicle, which comprises a continuous track 530 for movement of the vehicle.

As would be readily apparent to one skilled in the art, vehicles 500 shown in FIGS. 5A and 5B would include other components necessary for an operational vehicle, such as, for example, an engine, drive train, electrical system and the like. Such components could readily be incorporated by one skilled in the art into a vehicle using vehicle body 510 of the present invention.

In one embodiment of vehicle 500 of the present invention, the vehicle is of monocoque construction so that vehicle body 510 carries a majority of the stresses on the vehicle. In an embodiment such as that shown in FIG. 5A, the vehicle chassis or frame may be integral with vehicle body 510. The multi-layer material of the present invention functions as both a structural material for the vehicle, and as material that mitigates blast pressure and resists projectile penetration. The use of composite layer 113 in conjunction with hard metal layer 111 in sub-layer 110 advantageously provides a multi-layer structural and ballistic protection material significantly lighter in weight, on the order of one-half of the weight of conventional structural and ballistic panels for a given threat level. For example, a sub-layer 110 made from an innermost layer 117 of about 6 mm of DYNEEMA® HB 80, composite layer 113 of about 12.7 mm made from 50% by weight carbon fiber and 50% by weight S-2 glass fiber, hard metal layer 111 of about 6 mm of bainite steel (Bainite Flash 4130 Steel supplied by Sirius Protection, LLC) has an areal density 15.12 pounds per square foot for a threat level defined as a $V_{50}$ of 3500 ft./s (feet per second) for a 20 mm FSP. In contrast, an all RHA steel solution for the same threat level would be 21 mm thick and have an areal density of 33.9 pounds per square foot. An all-aluminum (AL 7039) solution for the same threat level has an areal density of 25 pounds per square foot. Advantageously, the multi-layer material of the present invention, such as sub-layer 110, provides structural and ballistic protection significantly lighter in weight than both conventional steel and aluminum solutions, providing a weight savings on the order of 40-50% without sacrificing ballistic protection.

Figure 5C:
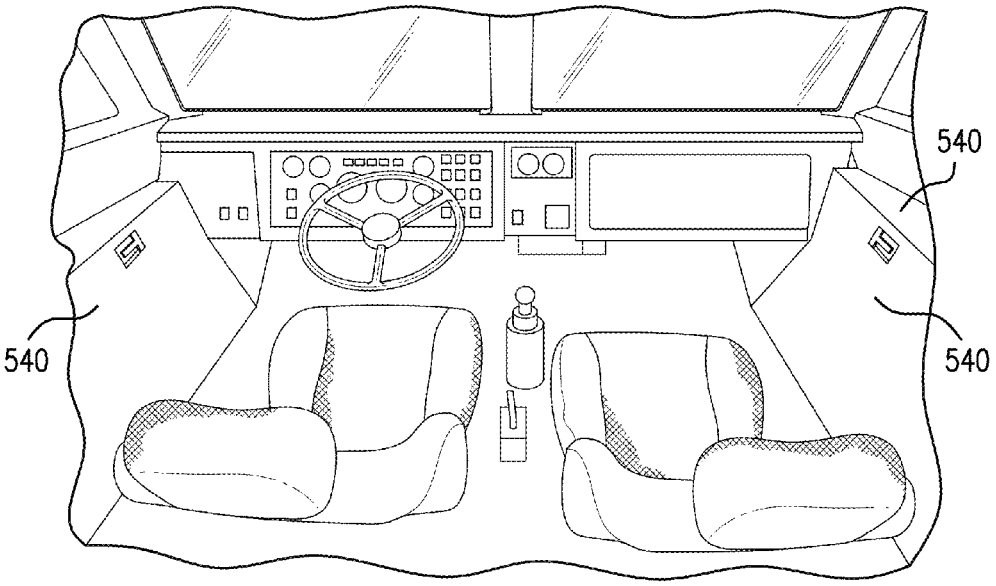
FIG. 5C is a top cutaway view of an interior of a vehicle made from a multi-layer material of the present invention.

As described above, innermost layer 117 of sub-layer 110 may be molded into soft shapes. In one embodiment of a vehicle of the present invention, innermost layer 117 is molded to form one or more trim items in an interior of the vehicle. Such trim items include, but are not limited to, door trim, inside door panels, and the like. Exemplary trim items 540 are illustrated in FIGS. 5A-5C. In such an embodiment, the trim items form part of the ballistic solution for debris that may have penetrated through to the innermost layer. The trim formed from such materials as DYNEEMA® and KEVLAR® function as a form of "catcher mitt" for this debris, while also functioning as trim items on the interior of the vehicle.

In other embodiments of the present invention, methods for making the multi-layer material are provided. The present invention embodies a manufacturing process which eliminates costly operations of traditional carbon fiber composites. The present invention begins with the spool of carbon fiber. Traditional carbon fiber composites require the fabrication of the carbon fiber threads into a textile which is then utilized to manufacture the composite layer. This textile operation is not required in the present invention. Further, traditional composites require a time consuming layering of the textile and the epoxy while the present invention composes the composite medium through a spraying method.

Figure 6A:
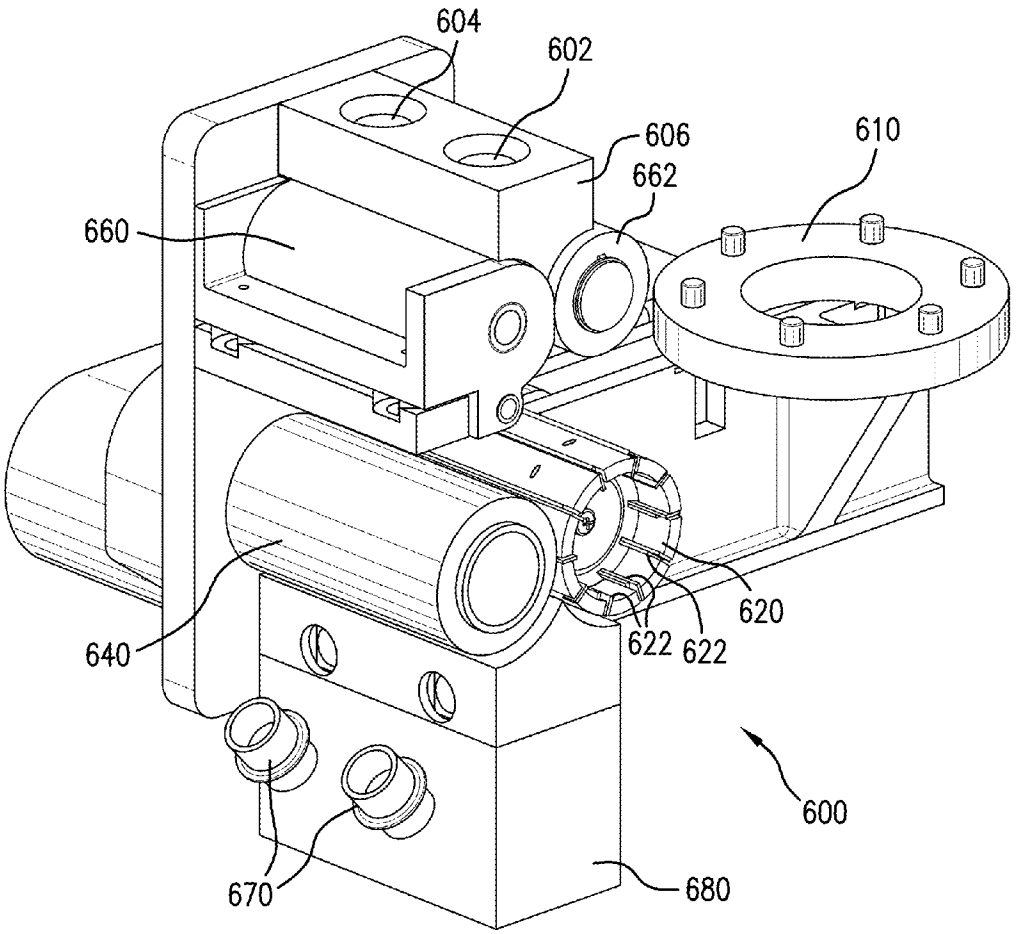
FIG. 6A is an isometric view of one embodiment of an apparatus for cutting fibers that may be used in the production of a composite material of the present invention.

In one aspect of the invention, a method for making composite layer 113 of multi-layer material 100 is provided. Turning now to FIG. 6A, an apparatus 600 for cutting fibers, including carbon and glass fibers useful in the production of composite layer 113, is illustrated. Exemplary fibers include TORAYCA® brand carbon fibers available from Toray Industries in Japan, such as the T700G carbon fibers (12,000 filaments), and S-2 glass fibers available from AGY, headquartered in South Carolina. Elongate lengths of fibers to be cut into shorter fiber lengths are fed into cutting apparatus 600. The elongate lengths of fibers are typically continuous lengths of fiber being fed from a bobbin, spool, or other source as known to one skilled in the art. The elongate lengths of fibers are fed into cutting apparatus 600 through apertures or fiber feed holes in a fiber feed block 606. In one embodiment, carbon fibers are fed into carbon fiber feed hole 602 and glass fibers are fed into glass fiber feed hole 604 in a manner readily apparent to one skilled in the art. Alternatively, both the carbon and the glass fibers could be fed into a single feed hole. The carbon fibers can be fed as a carbon fiber bundle, the bundle including a plurality of carbon fibers. Exemplary carbon fiber bundles may include from about 3,000 carbon fibers to about 12,000 carbon fibers. In one embodiment of the present invention, a weight ratio of carbon fiber to glass fiber in composite layer 113 is 1:1. Given that carbon is approximately half the weight of glass, a weight ratio of about 1:1 can be achieved by feeding two carbon fibers into feed hole 602 for every one glass fiber fed into feed hole 604. As would be apparent to one skilled in the art, the quantity of carbon fiber in relation to glass fiber can be adjusted to achieve a desired weight ratio of carbon fiber to glass fiber in composite layer 113. For example, the quantity of glass fibers in relation to carbon fibers could be increased to achieve a weight ratio of carbon fiber to glass fiber of about 1:1.5. In one embodiment, the elongate lengths of carbon and glass fiber are preferably cut by cutting apparatus 600 to shorter lengths in the range of approximately 14 mm to 180 mm. As would be readily apparent to one skilled in the art, the elongate lengths of fiber may be cut to shorter lengths less than 14 mm or greater than 180 mm.

In other embodiments of the present invention, other fiber types may be used in addition to, or instead of, carbon and glass, for example, aramid fibers such as KEVLAR® fibers, or thermoplastic fibers, such as ultra-high molecular weight polyethylene, such as DYNEEMA®, or nylon fibers. As would be readily apparent to one skilled in the art, apparatus 600 could be configured with additional feed holes to accommodate the use of additional fiber types.

Cutting apparatus 600 includes feed rollers 660 and 662, pressure roller 640, and knife roller 620. Feed roller 660 pivots based upon the thickness of the fibers being fed into the apparatus, while feed roller 662 remains fixed. Knife roller 620 may be configured with a plurality of knives 622. As shown in FIG. 6A, knife roller 620 may be configured with up to ten (10) knives 622. Knives 622 are preferably made from ceramic, high speed steel or other suitable material. Pressure roller 640 is preferably made from rubber, and is the surface against which the knives are chopping or cutting the fibers. Cut fibers are fired from cutting apparatus 600 under velocity from air movers 670 through holes (not shown) in the under portion of housing 680. As such, cutting apparatus 600 can be configured in the orientation shown in FIG. 6A, or rotated 90° in its orientation. In either the orientation shown in FIG. 6A, with the fibers being propelled downward toward a tool or mold surface, or rotated 90° with the fibers being propelled outward parallel to a tool or mold surface, the fibers are deposited on the tool or mold surface with loft supplied by the entrapped air from air movers 670.

The circumference of knife roller 620 determines the maximum length of the cut fiber that can be achieved with cutting apparatus 600. In an exemplary embodiment, the circumference of knife roller 620 is 180 mm, and can be configured with 10 knives 622. As would be apparent to one skilled in the art, in such an embodiment, the longest cut length of the fiber is 180 mm (one knife installed in knife roller 620), and the shortest cut length is 18 mm, if all 10 knives are installed in knife roller 620. Similarly, a cut length of 90 mm can be achieved with two knives installed, and 60 mm with three knives installed. Prior to commencing a cutting operation, cutting apparatus 600 is configured with an appropriate number of knives 622 to provide the desired cut length for the fibers. As readily apparent to one skilled in the art, other circumferences of knife roller 620 could be used, and knife roller 620 could be configured with a different number of knives 622.

As would be readily apparent to one skilled in the art, cutting apparatus 600, as well as cutting apparatus 601 described in more detail below with respect to FIG. 6C, could be configured to be robotically controlled to provide consistent and reproducible cutting of the fibers. Cutting apparatus 600 could be mounted to a robotic control apparatus through a mounting shown generally at 610 in FIG. 6A Cutting apparatus 600 could be configured so that the robotic control moves cutting apparatus 600 relative to the mold for forming the composite material, or cutting apparatus 600 could be fixed, and the mold moved relative to the cutting apparatus. Fixing the cutting apparatus and moving the mold for forming the composite material advantageously allows the use of a plurality of cutting machines for large parts, and provides a simpler and more uniform feed of the fibers to the cutting apparatus.

Figure 6B:
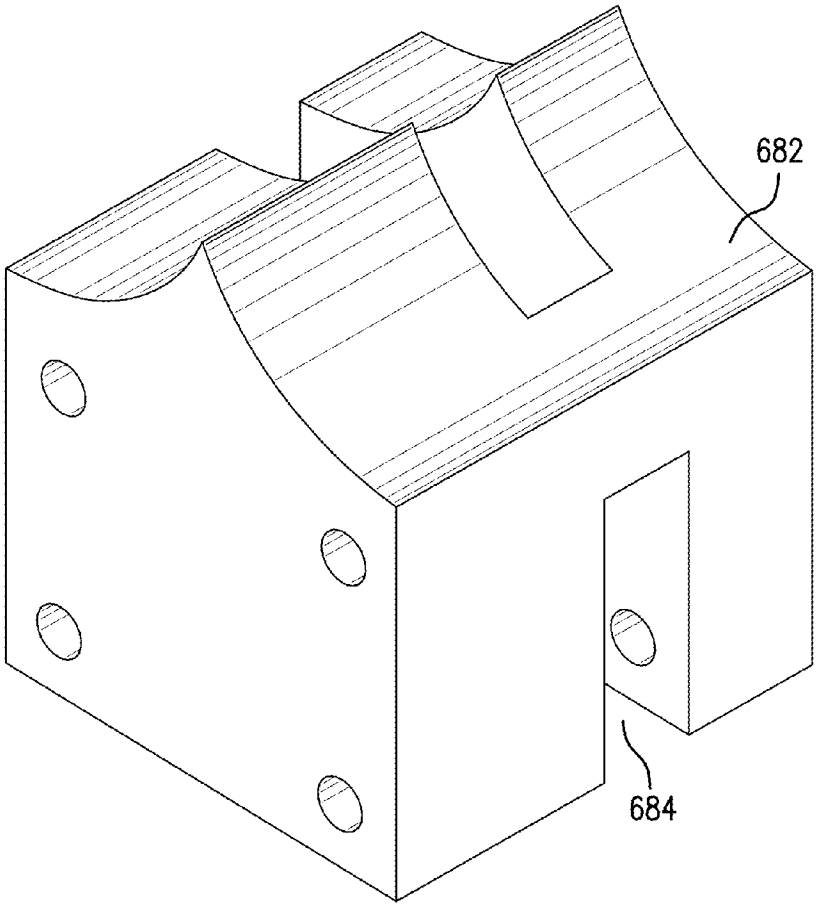
FIG. 6B is an alternate embodiment of a housing that may be used with the apparatus shown in FIG. 6A.

An alternate housing 682 for apparatus 600 is shown in FIG. 6B. Housing 682 provides a rectangular discharge aperture 684 for the fibers, thereby enabling at least a portion of the fibers discharged from the cutting apparatus to be aligned. In contrast to housing 680 shown in FIG. 6A, housing 682 does not include air movers 670 (the holes illustrated in FIG. 6B are mounting holes enabling housing 682 to be mounted on cutting apparatus 600 shown in FIG. 6A). As such, cut fibers exit cutting apparatus 600 by falling through discharge aperture 684. By configuring cutting apparatus 600 to move (through operation of, for example, robotic control) the cut fibers can be dragged in the direction of travel of the apparatus as the fibers exit discharge aperture 684, thereby providing alignment of at least a portion of the fibers. Although such a process for providing cut fibers having a degree of alignment may be slow, advantageously one cutting apparatus 600 can be used to provide both random cut fibers (when configured with housing 680) and cut fibers comprising a portion that are aligned (when configured with housing 682 shown in FIG. 6B).

Figure 6C:
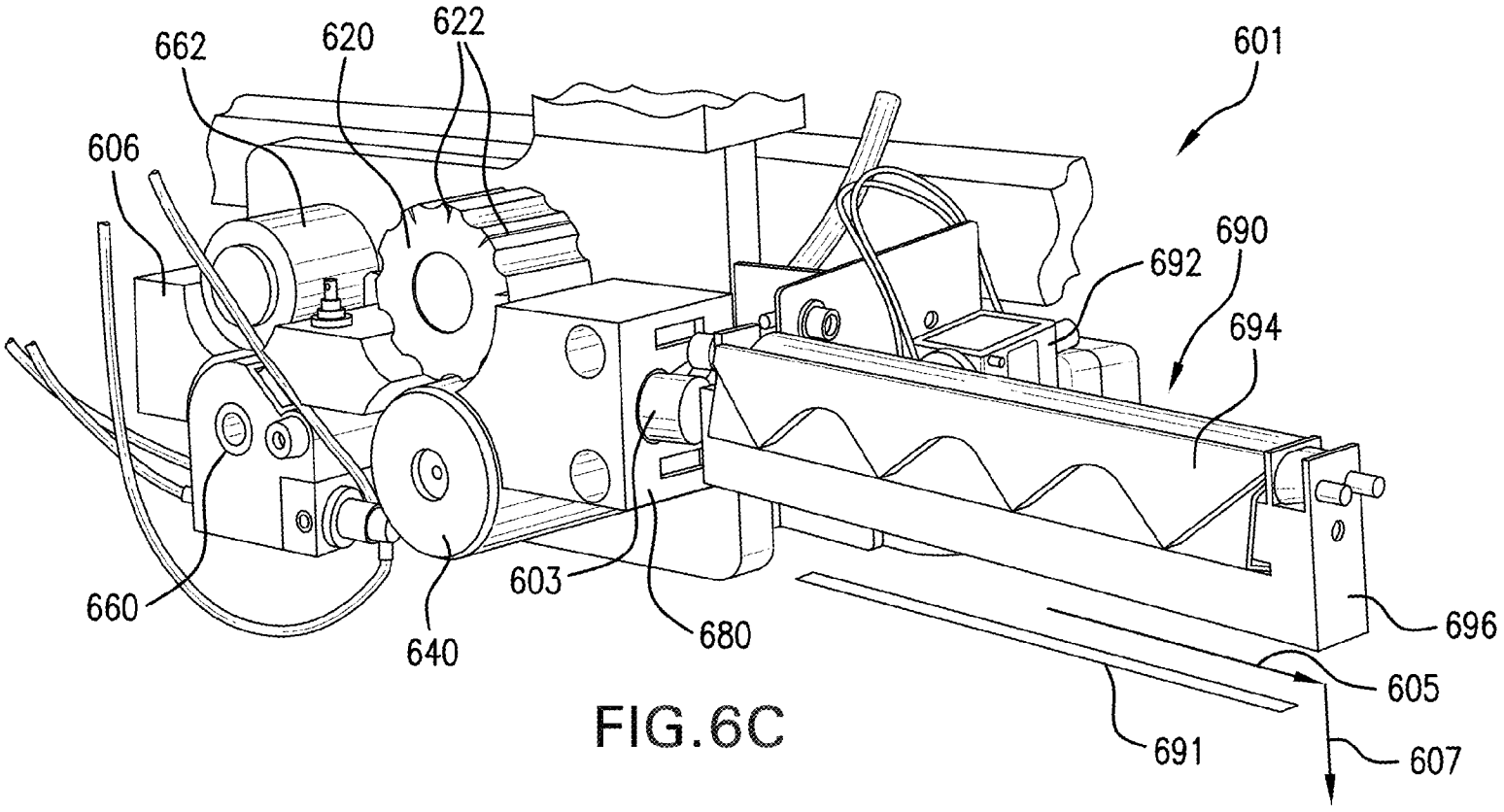
FIG. 6C is an isometric view of another embodiment of an apparatus for cutting fibers that may be used in the production of a composite material of the present invention.

Another embodiment of an apparatus for cutting fibers that may be used in the production of a composite material of the present invention is shown in FIG. 6C. Cutting apparatus 601 shown in FIG. 6C produces cut fibers that are aligned at a much faster rate than the configuration shown in FIG. 6B. However, cutting apparatus 601 shown in FIG. 6C can only produce aligned cut fibers, and cannot produce random cut fibers, whereas apparatus 600 shown in FIG. 6A can be used to produce both random and aligned fibers, depending upon which housing is used—680 for random and 682 shown in FIG. 6B for aligned.

Cutting apparatus 601 contains a number of components similar to those used in cutting apparatus 600 shown in FIG. 6A, including feed rollers 660 and 662, knife roller 620 with knives 622, pressure roller 640, and housing 680. Cutting apparatus 601 also includes fiber feed block 606 and feed holes 602 and 604 (not shown due to the orientation of cutting apparatus illustrated in FIG. 6C). Rather than fire cut fiber under velocity from air movers like cutting apparatus 600, cutting apparatus 601 includes a fiber discharge assembly 690 that is coupled to housing 680 through a tube 603.

Figure 6D:
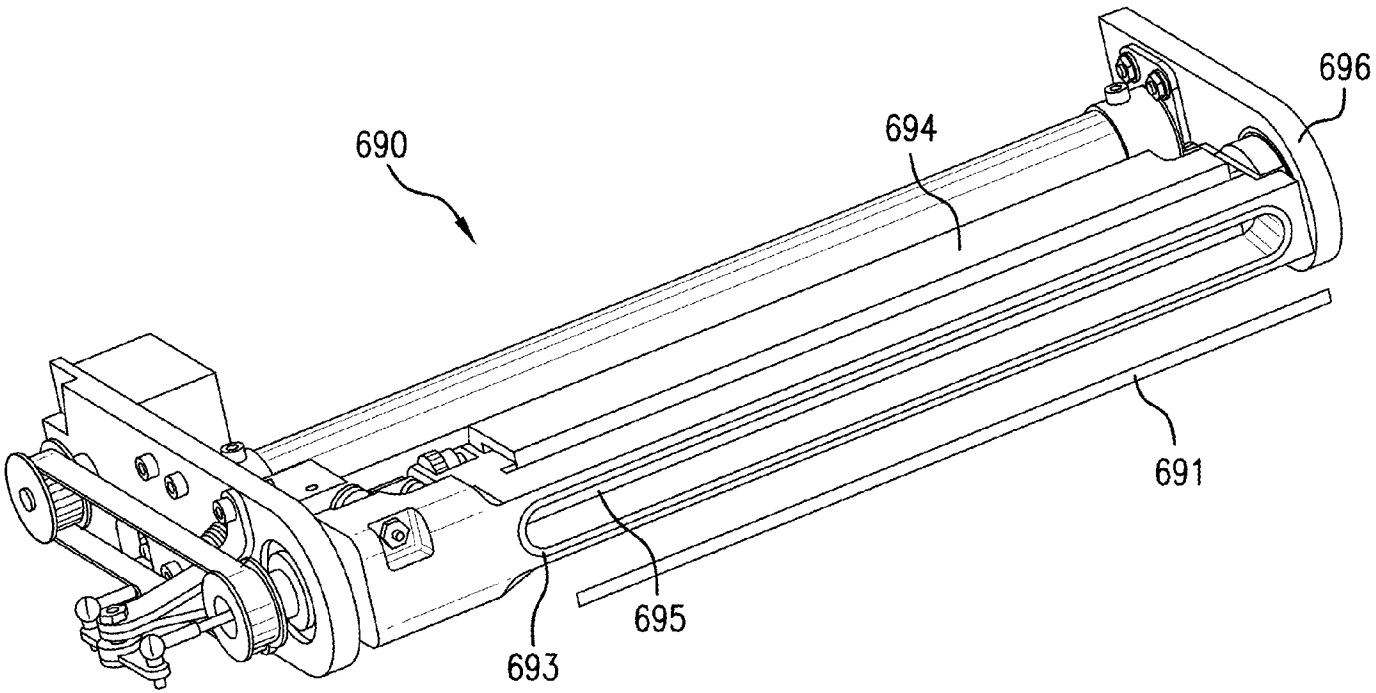
FIG. 6D is a view of the underside of a portion of the apparatus shown in in FIG. 6C.

Fiber discharge assembly 690 includes a pair of pivoting doors 694 coupled to mounting body 696. As shown in FIG. 6D, fiber discharge assembly includes an electrical coil 693 around the circumference of slot 695. A cut fiber 691 exiting fiber discharge assembly 690 is shown in FIGS. 6C and 6D. Cut fiber enters fiber discharge assembly 690 in a direction (shown by arrow 605 in FIG. 6C) parallel to the longitudinal axis of slot 695. Cut fiber undergoes a 90 degree change of direction (shown by arrow 607 in FIG. 6C) to be fired at the surface of a mold or tool, exiting from fiber discharge assembly through slot 695 as shown in FIG. 6D.

Fiber discharge assembly 690 relies upon the presence of magnetic particles on the fibers fed into cutting apparatus 601 passing through electrical coil 693 to accelerate the fibers out the apparatus. The magnetic particles may include cobalt, which is ferromagnetic. Methods for applying magnetic particles to fibers fed into cutting apparatus 601 will be explained in more detail below with respect to FIG. 7. Cutting apparatus 601 includes a solenoid 692 that produces a magnetic field. To release fibers from cutting apparatus 601, pivoting doors 694 are opened by pivoting them outwardly from mounting body 696 whereupon the cut fibers with the magnetic particles will accelerate through slot 695 in the direction indicated by arrow 607 in FIG. 6C.

The magnetic field produced by solenoid 692 will tend to align the magnetic fields of the magnetic domains within the magnetic particles of cut fiber 691 along the direction of the magnetic field produced by solenoid 692. Because cut fiber 691, which is now magnetized through action of solenoid 692, is in motion, the flux of its magnetic field through a surface bounded by electrical coil 693 (e.g., the surface formed on the plane of electrical coil 693) will vary, inducing a current within electrical coil 693. The magnetic field produced by this induced current will be in a direction that tends to oppose the change in magnetic flux through the surface bounded by electrical coil 693 that is generated by the motion of magnetized cut fiber 691. The net effect is that cut fiber 691 will be repelled by and ejected through electrical coil 693 and slot 695.

As such, cut fibers exiting from cutting apparatus 601 are aligned in the direction of orientation of fiber discharge assembly 690. The orientation of the alignment of the cut fibers is determined by the angle of discharge assembly 690 relative to the surface of the mold or tool, rather than by the direction of travel of the cutting apparatus, as was the case with respect to cutting apparatus 600 configured with housing 682 shown in FIG. 6B. As would be readily apparent to one skilled in the art, cutting apparatus 601 produces cut fibers only in an aligned arrangement while cutting apparatus 600 produces cut fiber either random or aligned. Moreover, cutting apparatus 601 can produce cut fibers in an aligned arrangement much faster than cutting apparatus 600.

Composite layer 113 also preferably includes epoxy. In one embodiment of the invention, epoxy is applied to the elongate lengths of fiber, and the fiber then rolled back onto the spool or bobbin that feeds a cutting device, such as cutting apparatus 600 or 601. If magnetic particles are to be used, such as cobalt particles, the magnetic particles can be screen printed on to the fiber in a manner known to one skilled in the art. One disadvantage of such a method that requires rolling the fiber back onto the spool or bobbin is that the tension on the fiber may cause the epoxy to become tacky enough to stick to the fiber layer above it on the spool. To overcome this disadvantage, a second method was developed to apply the epoxy as the elongate lengths of fiber are being continuously fed into the cutting apparatus. By applying the epoxy to the fibers just before the fibers enter the cutting apparatus, that is, just prior to cutting, the problem associated with the fibers sticking was avoided.

Figure 7:
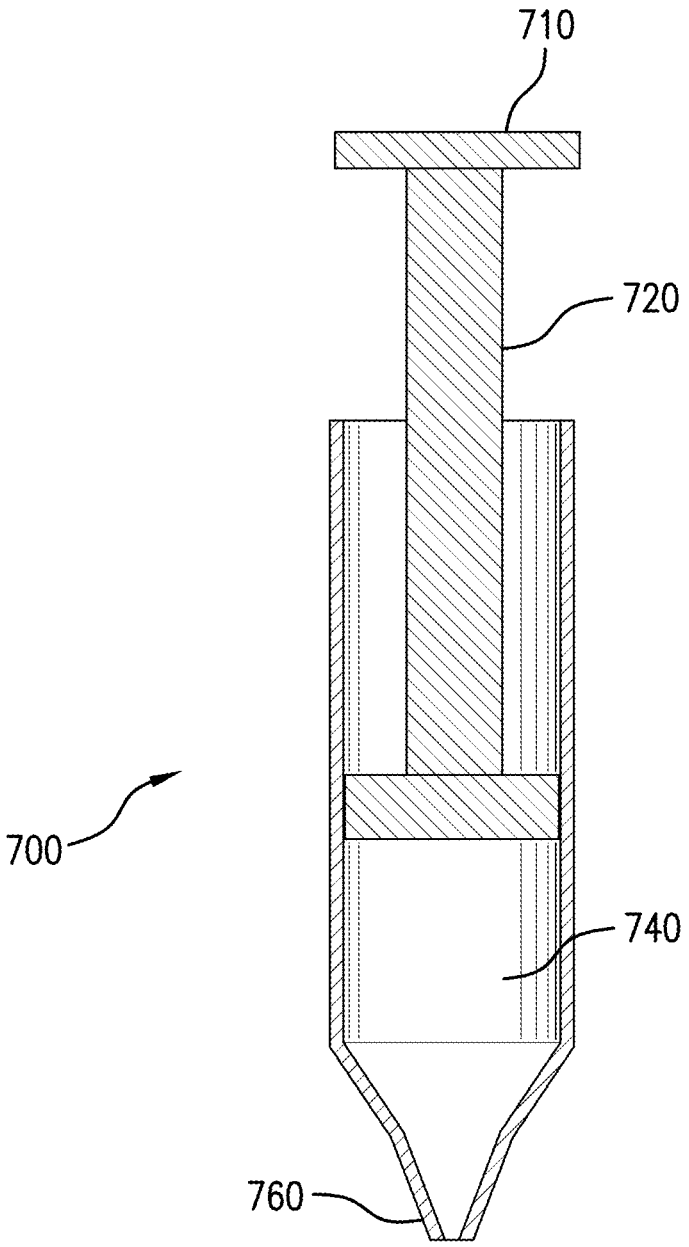
FIG. 7 is a cross-section of an apparatus for dispensing epoxy paste useful in the production of a composite material of the present invention.

An apparatus 700 to apply the epoxy to the fibers as they enter the cutting apparatus is illustrated in FIG. 7. As shown in FIG. 7, a plunger 720 is used to push epoxy paste 740 through nozzle 760. Apparatus 700 may take a variety of shapes, such as round, square, rectangular, or other suitable shapes. Apparatus 700 may preferably be controlled through operation of a servo control, a connection for which is illustrated generally at 710 and known to one skilled in the art. In one embodiment, epoxy paste 740 includes fine particles of magnetic material, such as iron, nickel or cobalt, mixed in with the epoxy. The magnetic particles may be in the form of a powder, with particle sizes on the order of about 2-6μ. The magnetic particles are preferably evenly dispersed within the epoxy fluid, making it more viscous, like a honey or paste. Cobalt powder particles are particularly preferred as they are more magnetic than nickel, do not rust like iron, and do not exhibit the safety concerns of pure cobalt powder when mixed with the epoxy fluid. As would be readily apparent to one skilled in the art, the selection of a suitable epoxy will depend upon the environment to which the composite material will be exposed, particularly the upper temperature limit. Preferably, an epoxy is selected that has a glass transition temperature ($T_g$) lower than the upper temperature limit to which the composite material will be exposed. Suitable epoxy materials are available from, for example, Huntsman Advanced Materials or Hexcel. Alternatively, a vinyl ester (blend of epoxy and polyester) or a thermoplastic (such as nylon) could be used in place of an epoxy.

In operation, the epoxy paste is applied to a length of fiber, preferably stiff fiber such as carbon fiber, which may be referred to as a carbon fiber tow or carbon tow. Plunger 720 is depressed to force epoxy paste 740 (for example, epoxy with or without magnetic particles) out though nozzle 760. The carbon fiber tow may be configured to move front to back (i.e., into and out of the plane of the cross-section shown in FIG. 7) while nozzle 760 is moved left to right through operation of the servo control. In so doing, a ridge of epoxy paste is deposited on the carbon fiber tow that has sufficient viscosity not to wet out, and provides a good concentration of the magnetic particles. As would be readily apparent to one skilled in the art, apparatus 700 could be configured in a number of ways to accommodate the relevant movement between the carbon fiber and the dispensing apparatus itself. Preferably, apparatus 700 is applying the epoxy to the elongate lengths of fiber just prior to the fiber entering cutting apparatus 600 or 601.

In other embodiments, the epoxy may include other particles instead of or in addition to magnetic particles. For example, ceramic platelets may be added to the epoxy and applied to the fiber. Such ceramic platelets may be silica or alumina, and would appear as irregularly shaped flat flakes. Rubberized particles may also be used. Preferably, the epoxy with particles is applied to the stiffer fiber. For example, in the case of carbon and glass fibers, the epoxy with magnetic particles would be applied to the carbon fibers, but not to the glass fibers. In other embodiments, the epoxy with magnetic and/or other types of particles may be applied to more than one fiber type. Use of apparatus 700 to apply the epoxy to the fibers allows for control of the resin content in the finished composite material by controlling the amount of epoxy dispensed onto the fiber. Generally, the "drier" the composite material (drier referring to lower resin content), the better the ballistic performance because more fibers can move and stretch as there is less resin present to hold the fiber in place.

In an alternative embodiment of the present invention, epoxy in powder form may be used. In such an embodiment, epoxy powder is sprayed while simultaneously cutting the fibers. For example, cutting apparatus 600 as shown in FIG. 6A may be configured with a powder sprayer on the bottom of housing 680. In such an embodiment, a fluidized bed may be used to get the epoxy powder in suspension, which is then pumped as a fluidized mass. A burner is provided to heat the air from air movers 670. The heated air and the epoxy powder are pumped through a tube so that the heated air can warm the epoxy powder, making the epoxy powder particles sticky or tacky, enabling the fibers being simultaneously cut by cutting apparatus 600 to stick to the mold or tool. The resin content can be controlled, for example, by controlling the rate of pumping the epoxy powder into the heated air tube. As known to one skilled in the art, epoxy powder can be formed by mixing the resin and hardener, casting the solid form into a block, and grinding the block into powder form. The use of liquid epoxy and apparatus 700 of the present invention is preferred as it eliminates the steps of preparing the epoxy powder, and likely allows the epoxy to be applied to the fibers more quickly than by spraying epoxy powder.

Fibers to which particles have been applied will be carrying more mass than fibers without particles. For cobalt particles, the mass increases by about 4%. In an embodiment of the invention in which the fibers having the cobalt particles are aligned, the aligned fibers have increased mass. Because tensile strength increases with alignment, it is believed that such aligned fibers would provide increased ballistic protection. The use of magnetic particles on the fibers also advantageously allows the use of magnets on the mold or tool to hold the alignment of the fibers (up to about 4 mm in thickness) set by the orientation of, for example, fiber discharge assembly 690.

The use of a cutting apparatus such as cutting apparatus 601 shown in FIG. 6C advantageously allows for the use of a plurality of such devices with multiple feeds of fiber into each cutting apparatus that can be staggered (when viewed in plan) so that the ends of the cut fibers are not in a straight line. In such a staggered configuration of aligned fibers, the failure point advantageously will not be a straight line.

As deposited by cutting apparatus 600 or 601, the cut carbon and glass fibers, referred to herein as a "charge," include entrapped air, providing a three-dimensional deposit that exhibits a degree of "loft." Charge 900 may be, for example, on the order of 1.5 inches or about 38-40 mm in height. As explained in more detail below, the charge comprises an arrangement of discontinuous or discrete cut fibers that results in a non-uniform fiber fraction. By "fiber fraction" is meant the percentage of fiber per unit volume, $V_f$. In any volume of charge 900, the distribution of the fiber throughout that volume is not uniform.

Figure 9A:
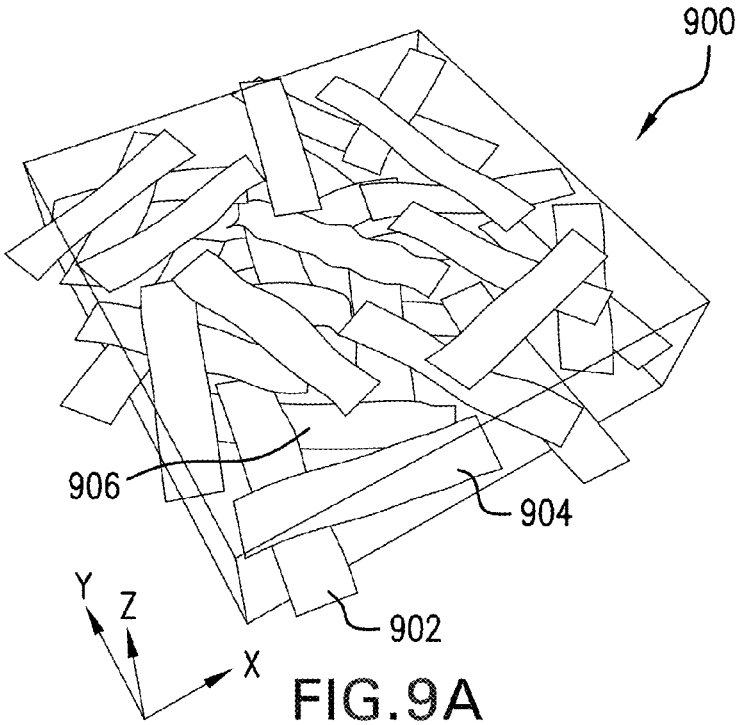
FIG. 9A is an illustration of carbon and glass fibers after cutting by an apparatus such as that shown in FIG. 6.

An exemplary charge 900 as deposited with loft is illustrated in FIG. 9A. As explained above, fibers, such as glass and carbon fibers, are cut into discrete lengths by apparatus 600, and are fired from apparatus 600 under velocity from air movers 670. Consequently, charge 900 includes fibers that extend through the charge three-dimensionally at an angle in the "Z" direction as shown in FIG. 9A. For example, as shown in FIG. 9A, fiber 902 overlays fiber 906 and extends under fiber 904. As such, charge 900 includes fibers that are at an angle in three dimensions, and charge 900 is not layered in two dimensions like a textile. Cutting the fibers to shorter lengths increases the number of fibers that are at an angle in the Z direction. The longer the fibers get, the more they tend to fall, rather than penetrate through the charge.

Having fibers that are at an angle in the Z direction, such as fiber 902, advantageously provides fibers that hold the other fibers together. Fibers in the Z direction provide a fiber-to-fiber interface that increases the inter-laminar shear of the material. Consequently, inter-laminar shear is not solely governed by the resin in the composite material, which is advantageous as fiber is considerably stronger than the resin. As discussed above, the fibers cut by apparatus 600 as shown in FIG. 6A are fired from apparatus 600 in a random fashion without alignment. If fibers are cut with an apparatus configured for providing alignment of the fibers, such as with apparatus 600 configured with housing 682 illustrated in FIG. 6B, or apparatus 601 illustrated in FIG. 6C, there will still be fibers in the Z direction, but there will be less of them than when random fibers are produced.

The fibers illustrated in charge 900 in FIG. 9A have a random configuration, with little or no alignment, such as produced through apparatus 600 illustrated in FIG. 6A. Fibers cut using an apparatus that provides for fiber alignment, such as apparatus 600 configured with housing 682 illustrated in FIG. 6B, or apparatus 601 illustrated in FIG. 6C, will form a composite material with a higher fiber fraction, that is, a higher percentage of fiber per unit volume. The higher the degree of alignment, the higher the fiber fraction. A fiber fraction for random fibers would typically be about 50%, and a fiber fraction for aligned fibers would be on the order of about 60-64%. A higher fiber fraction, and the resulting higher tensile strength, may be advantageous for material that provides ballistic protection, such as from projectile impact.

The composite material of the present invention, such as composite layer 113 illustrated in FIGS. 1 and 2, is discontinuous in that the fibers are not in continuous layers, but rather, are in discrete lengths, with no discrete boundaries between layers of fibers. The composite material may be made from fibers of different lengths. For example, when carbon and glass fibers are being used, the carbon fibers may be of a different length than the glass fibers, or as another alternative, varying lengths of carbon fibers or varying lengths of glass fibers may be used. The composite material of the present invention may also include a random arrangement of fibers, or fibers that are all or partially aligned, or a mixture of random and aligned fibers. The composite material may be made from a plurality of fiber types, including but not limited to, carbon fibers, glass fibers, aramid fibers, thermoplastic fibers such as polyester fibers, natural fibers such as hemp, and aromatic polyamide fibers. Two, three, or more fiber types may be used in making the composite material. Advantageously, the composite material of the present invention has a non-uniform fiber fraction, $V_f$. That is, in any volume of the composite material, the distribution of the fiber throughout that volume is not uniform. Some portions of the volume will be more fiber rich than other portions, and some portions will be more resin rich than other portions. Therefore, the inter-laminar shear will vary depending upon whether the portion is more fiber rich ("drier") or more resin rich. The higher the fiber fraction (more fiber rich), the higher the inter-laminar shear, and the energy required to split it apart is higher. The higher the fiber fraction, the better is the ballistic performance, that is, the better the ability to provide protection from projectile impact.

Figure 8:
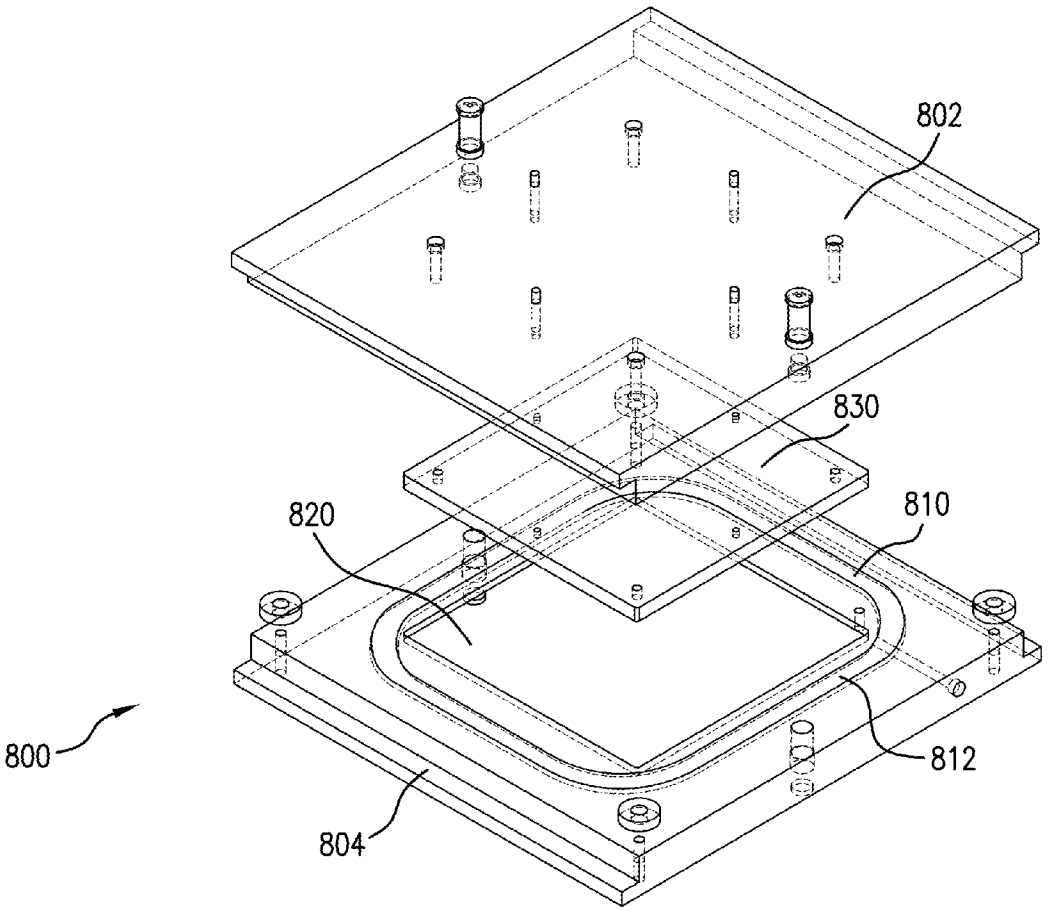
FIG. 8 is an exploded isometric view of a tool useful in the production of a composite material of the present invention.

FIG. 8 is an exploded isometric view of a vacuum compression tool 800 useful in the production of a composite layer of the present invention. Tool 800 includes a top plate 802 and a bottom plate 804. Bottom plate 804 may provide a support base and be affixed to a vacuum press. Bottom plate 804 includes a groove 810 in which is placed a vacuum seal 812, such as a silicon seal. Bottom plate 804 also includes a depression 820 into which will be placed a charge of cut fibers, such as charge 900 illustrated in FIG. 9A and described above. Tool 800 also includes a clamp plate 830 disposed between top plate 802 and bottom plate 804. Preferably, clamp plate 830 is spring loaded (spring not shown in FIG. 8).

Figure 9B:
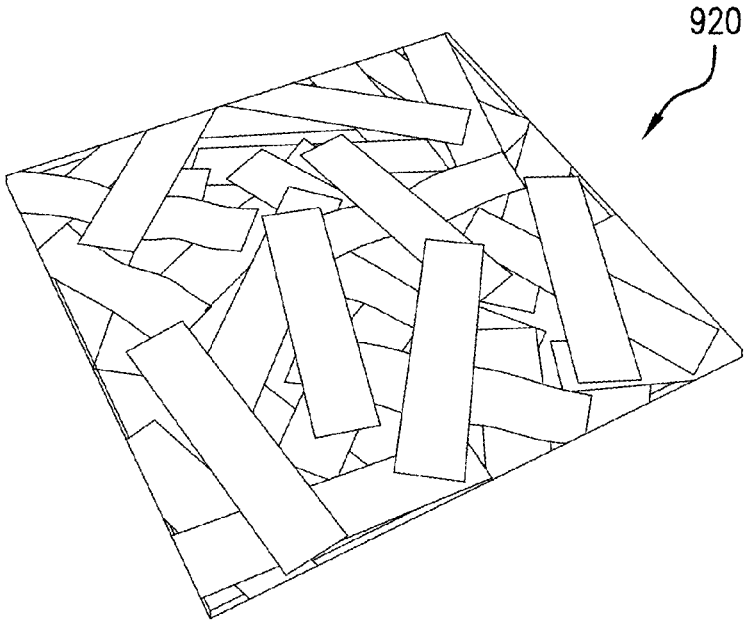
FIG. 9B is an illustration of carbon and glass fibers after vacuum compression in an apparatus such as that shown in FIG. 8.

In operation, charge 900 is placed or deposited within depression 820. Spring-loaded clamp plate 830 holds charge 900 in place within depression 820. Top plate 802 is lowered until it contacts vacuum seal 812. Vacuum is then applied, and top plate 802 continues to be lowered until it is mated with bottom plate 804, at which point the tool is completely closed, and charge 900 is compressed. Vacuum is continued to be applied so that the air is all or partially removed from charge 900. A charge after application of vacuum, such as through tool 800, is shown in FIG. 9B (identified as 920). In contrast with charge with loft 900 shown in FIG. 9A, charge 920 after application of vacuum and compression through the use of tool 800 has some or all of the air removed and is reduced in height.

Once the tool is closed, heat is applied to the charge, thereby also heating the resin in the charge. For example, a charge containing carbon and glass fibers and epoxy was heated to approximately 60° C. for about 2-3 minutes. The charge is retained within the heated compression tool 800 long enough to get the epoxy resin to be sticky or tacky, but not long enough to initiate the curing process, to thereby form what will be referred to herein as a composite preform. As discussed above, the charge, and hence the resulting composite preform, have a non-uniform fiber fraction, $V_f$. The composite preform is preferably cured in a subsequent curing step. In a preferred method of the present invention, the curing step is carried out during assembly of the final structure being made, such as during assembly of a vehicle body as described below with respect to FIG. 11.

As would be readily appreciated by one skilled in the art, tool 800 could be configured to form many different three-dimensional shapes of many different sizes. The size and shape of tool 800 can be adjusted to prepare, for example, some or all of the components of the vehicle body shown, for example, in FIGS. 5A and 5B. Alternatively, tool 800 could be used for making other types of objects made from composite layer 113 of the present invention, such as inserts for vests and other personal garments to provide impact and blast protection for military and security personnel. In addition, as would be readily apparent to one skilled in the art, the vacuum and pressure applied with the use of tool 800 can be varied, as can the architecture of fiber that is used (for example, use of all carbon fibers, all glass fibers, or other differing fiber types, or alignment of the fibers).

The characteristics of the composite material formed through the use of tool 800 can be varied by adjusting one or more of three variables: 1) amount of vacuum applied that reduces the amount of trapped air in charge 900; 2) amount of pressure or compression pushing the air from the charge (compression is typically needed as there is no easy air path due to the random nature of the fibers in the charge); and 3)

type of fibers in the preform, which affects the size of the resin-rich areas. Because resin is weaker than fiber, cracks will start in the resin.

To provide optimal ballistic protection performance, it is desirable to have the finished composite material act like a "catcher's mitt" in baseball as the round hits the composite material. That is, as the ball hits the mitt the mitt keeps moving in the direction of ball travel, reducing the speed of the ball. It is desirable to do the same with the composite material—stretch the fiber, and get inter-laminar failure of the resin and fiber interface. Both stretching and inter-laminar failure slow the round down, and it is desirable to increase the area in which stretching and inter-laminar failure occur.

Unlike conventional composite material, the composite material of the present invention purposefully includes imperfections so that micro-cracks will form earlier than in a conventional composite when the composite material is loaded from, for example, an incoming projectile. Most conventional composites are configured to be "void free" to minimize crack propagation. A composite that includes imperfections that lead to micro-crack propagation would provide improved ballistic performance. For example, it is desirable from the perspective of ballistic protection to initiate a crack in the composite material as a round or projectile penetrates the composite material. For example, the operation of vacuum compression tool 800 can be adjusted to leave some air or voids in the composite layer so that micro-cracks will form that are able to absorb a larger amount of energy. As would be appreciated by one skilled in the art, if the number of voids is too high, then the composite layer will not provide sufficient structural or ballistic protection performance A void content on the order of less than about 10% by volume, such as 2-4%, 4-6%, 6-8% or 8-10%, is believed to provide improved ballistic performance. Preferably, the void content is uniformly distributed within the composite material. By varying the level of vacuum and pressure used with vacuum compression tool 800 the level (e.g., percent by volume) of the voids in the composite material can be controlled, thereby providing a way to vary or control the ballistic performance of the composite material.

As would be recognized by one skilled in the art, the weakest part of the composite material is the epoxy, that is, the resin. By increasing the resin-rich areas of the composite material, it may be possible to have earlier crack propagation through the composite material, thereby increasing the ability of the composite material to absorb energy. One way to increase the size of the resin-rich areas of the composite material is to increase the number of carbon fibers used. For example, composite material made in accordance with the present invention using a bundle of 12,000 carbon fibers resulted in larger resin-rich areas than did composite material made using a bundle of 3,000 carbon fibers.

As described above, the multi-layer material of the present invention includes a hard metal layer, such as hard metal layer 111, and the multi-layer material may be used to form vehicles, such as those illustrated in FIGS. 5A and 5B. In order to form the complex three-dimensional structures that may be required in making vehicles from the multi-layer material of the present invention, a method for forming a three-dimensional metal structure has been developed that can be used on hard metal, such as bainite steel or RHA steel. The method is particularly advantageous as it reduces the number of weld operations needed to assemble the vehicle.

Figure 10A:
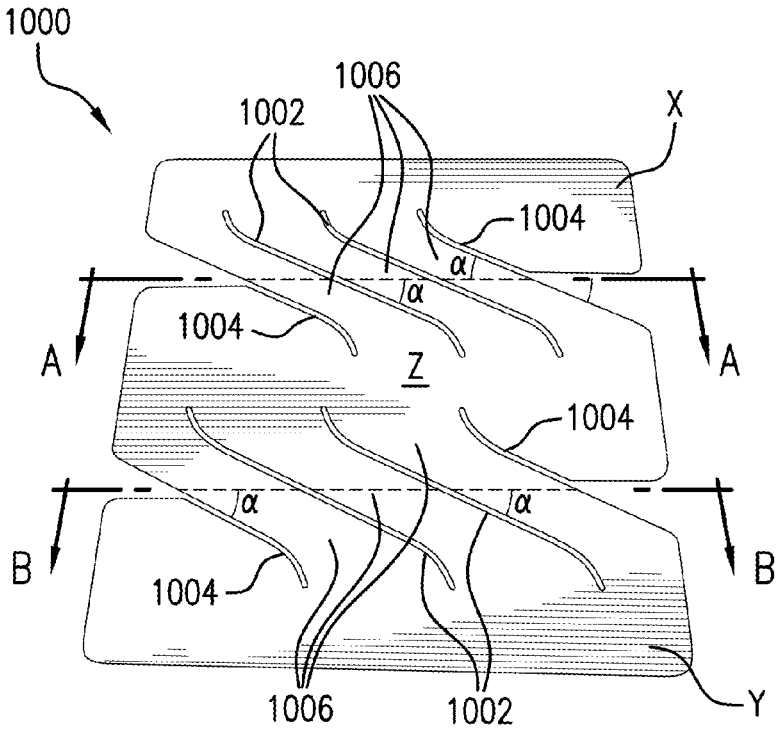
FIG. 10A is a hard metal sheet blank in a two-dimensional state.

With reference now to FIG. 10A, a hard metal sheet blank 1000 in a two-dimensional state is shown. A plurality of slots 1002 and 1004 are formed in sheet blank 1000. In one embodiment, slots 1002 and 1004 do not completely penetrate a thickness of sheet blank 1000, that is, they do not go all the way through the sheet. Interposed between adjacent slots 1002 and slots 1004 are a plurality of straps 1006 of solid metal material.

Two fold lines, A-A and B-B are illustrated in FIG. 10A. As shown in FIG. 10A, fold lines A-A and B-B are not perpendicular to any of straps 1006, slots 1002, or slots 1004. Rather, fold lines A-A and B-B form an angle $\alpha$ with straps 1006, slots 1002, and slots 1004. In one embodiment, angle $\alpha$ formed by fold lines A-A or B-B with straps 1006 may be in the range of from about 35° to about 45°. As shown in FIG. 10A, slots 1002 cross fold lines A-A and B-B, whereas slots 1004 do not cross the fold lines.

Figure 10B:
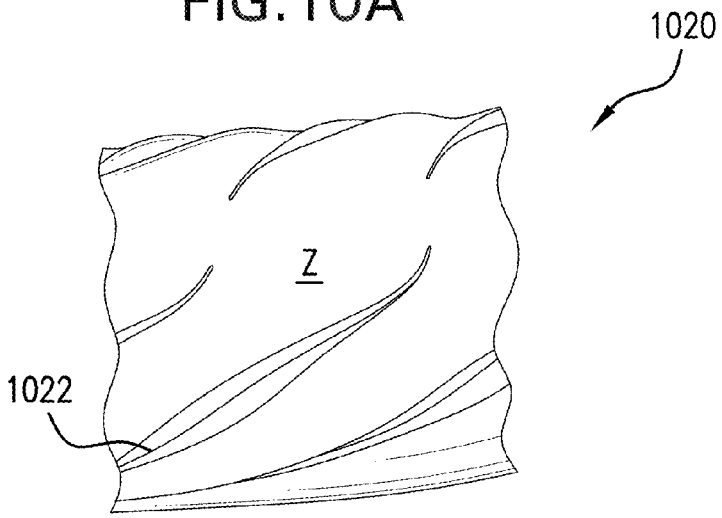
FIG. 10B is the hard metal sheet blank of FIG. 10A after folding around fold lines A-A and B-B.

To form a three-dimensional metal structure from sheet blank 1000 shown in FIG. 10A, portion X of sheet blank 1000 is bent toward portion Y around fold line A-A, and portion Y is bent toward portion X around fold line B-B. The resulting three-dimensional metal structure 1020 is illustrated in FIG. 10B. Portion Z of sheet blank 1000 appears in three-dimensional structure 1020, portions X and Y having been folded around fold lines A-A and B-B so that they are beneath surface Z in three-dimensional structure 1020. FIG. 10B also illustrates slot 1022, the result of a slot 1002 that crosses a fold line that widens on the surface furthest away from the fold line as a result of the folding operation.

The method of forming a three-dimensional metal structure of the present invention was developed to allow the folding of sheet material with low force and a significantly tighter internal bend radius than conventional methods. The method permits the design of highly complex folded structures for various applications, including vehicles made from the multi-layer material of the present invention. The geometry of the slots generates a precise fold region with the material in the fold region experiencing a combination of plain strain and limited shear strain. The combination of twisting and natural folding allows the slot method of the present invention to work with high tensile strength and brittle materials, which otherwise would not be able to be folded without fracture. An important aspect of the method of the present invention is that the slots (e.g., slots 1002 and 1004) are not parallel to the fold line (e.g., fold lines A-A and B-B shown in FIG. 10A), and straps, e.g., straps 1006 shown in FIG. 10A, are not perpendicular to the fold line, but rather, are at an angle $\alpha$ to the fold line. Consequently, when the sheet blank is folded around the fold lines, the sheet straps twist, but they do not bend. The sheet blank as a whole is folded, and the sheet straps twist around the fold lines. In conventional methods of bending sheet metal, as set forth, for example, in U.S. Pat. Nos. 6,640,605 and 6,481,259, the straps are perpendicular to the bend line, and the thinned regions or slits are parallel to, and do not cross, the bend line. In the present invention, the angle of the straps with respect to the fold line is a function of how brittle the metal material is, as well as the thickness of the sheet of metal material. More brittle metal will have a smaller angle, and less brittle (more ductile) metal will have a larger angle. For example, an angle of 35° is suitable for a hard brittle steel such as bainite steel, while an angle of 45° is suitable for a more ductile metal like copper or aluminum.

In an exemplary embodiment, sheet blank 1000 would be in the range of about ¼" thick for bainite steel, and 4-4.5 mm thick for RHA steel. As would be readily appreciated by one skilled in the art, other thicknesses of hard metal sheet blanks could be used. It should be appreciated, however, that as the sheet blank is folded around the fold line, if the slot closes up such that the opposing surfaces contact each other, the sheet blank cannot be folded further around the fold line, unless the slot is widened. As would be understood by one skilled in the art, the longer the fold line, the greater the number of straps of solid metal material that have to be twisted around the fold line. Consequently, the number of straps could become a factor limiting the length of a fold line.

An advantage of the slot method of the present invention over conventional methods is eliminating the need to account for a bend allowance, that is, the stretching of material when it is bent or folded in a conventional manner. In a conventional method, thinning forms the bend, and, as a result, compensation must be made for bend allowance. Moreover, metals get harder with age, and the bend allowance is different on old metal material than it is on new metal material. These differences are typically fractions of a millimeter, but these differences stack up in the bend allowance. Because the slot method of the present invention does not rely on thinning to form a bend, no compensation need be made for bend allowance. In particular, the straps of solid metal (e.g., straps 1006 in FIG. 10A) are a constant thickness all the way through across the sheet of metal material.

As would be readily appreciated by one skilled the art, the shape and size of the blank can be varied, as can the size, number, location, and orientation of the slots, in order to form three-dimensional metal structures of various shapes and sizes. For example, the slot method of the present invention could be used to form door frames and other parts of vehicles 500 illustrated in FIGS. 5A and 5B. In addition, a spray coat such as plasma coating 411 described above could be applied to three-dimensional metal structures produced by the slot method of the present invention. The present invention advantageously provides a method of forming parts that necessitate the part being folded back on itself, such parts being difficult to make with conventional methods and tooling. The slot method of the present invention is particularly advantageous in applications where thick metals are needed, such as in military and security applications. The slot method of the present invention advantageously provides a precision process to form parts from thick, hard metal. As would be readily appreciated by one skilled in the art, the slot method of the present invention can be used to form three-dimensional metal structures for a variety of applications and uses, including, but not limited to, vehicles, bridges, highway supports, structural supports for buildings, and the like.

An exemplary process of the present invention for assembling a vehicle body or portion thereof using the materials of the present invention will now be described. The vehicle body may be assembled, for example, from one or more plasma coated steel panels, such as hard metal layer 111 to which plasma coating 411 has been applied. One or more of the plasma coated steel panels may be a steel sheet blank folded in accordance with the slot method of the present invention to which plasma coating 411 has been applied. Less than all, preferably all but one, of the various plasma coated steel panels for the vehicle body are welded together in a manner known to one skilled in the art to form a steel shell with an opening. At least one plasma coated steel panel is left off, preferably the rear panel that forms the rear of the vehicle body, in order to provide access into the interior of the vehicle body. The interior surface of the welded plasma coated steel panels forming the steel shell is then sprayed with a contact adhesive that will hold the various composite preforms in place. Suitable contact adhesives include those that do not react with the epoxy resin in the composite preforms, such as 3M Spray Mount (an aerosol spray adhesive). The contact adhesive forms a tacky or sticky surface on the interior surface of the steel shell to which the composite preforms are adhered. The composite preforms are preferably made using the methods and apparatus described above, and each preferably comprises an epoxy and a plurality of fiber types with a non-uniform fiber fraction. Adjacent composite preforms, such as, for example, the composite preforms on the front of the vehicle and composite preforms on the side of the vehicle, are preferably joined through the use of a scarf joint. As would be readily apparent to one skilled in the art, such a scarf joint provides a long overlap and mating surface that can be adjusted in relation to the other due to tolerances or change in length of one of the composite preform parts. In addition, the tapered edges associated with a scarf joint can readily be made using the method of making a composite preform as described herein, or other suitable methods, as tapered edges do not need to be molded into a composite preform like a square edge. After the composite preforms are adhered to the interior surface of the steel shell by contacting them with the contact adhesive, the remaining one (or more) of the plasma coated steel panels (e.g., the rear panel) is welded to the steel shell to thereby close the opening.

In a next step, a heat stabilized nylon film, such as a CAPRAN® film made by Honeywell Inc., Morristown, N.J., is inserted into the interior of the vehicle (through, for example, the opening where the roof will be installed or a hole in a previously attached roof). A vacuum is applied to remove the air between the film and the composite preforms, thereby pulling the composite preforms toward the plasma coated steel panels to thereby form a composite adhered steel shell. The film could be left in the vehicle body in areas other than the location of windows or doors, or it could be removed, for example, by using a release ply between the composite preforms and the film.

Figure 11:
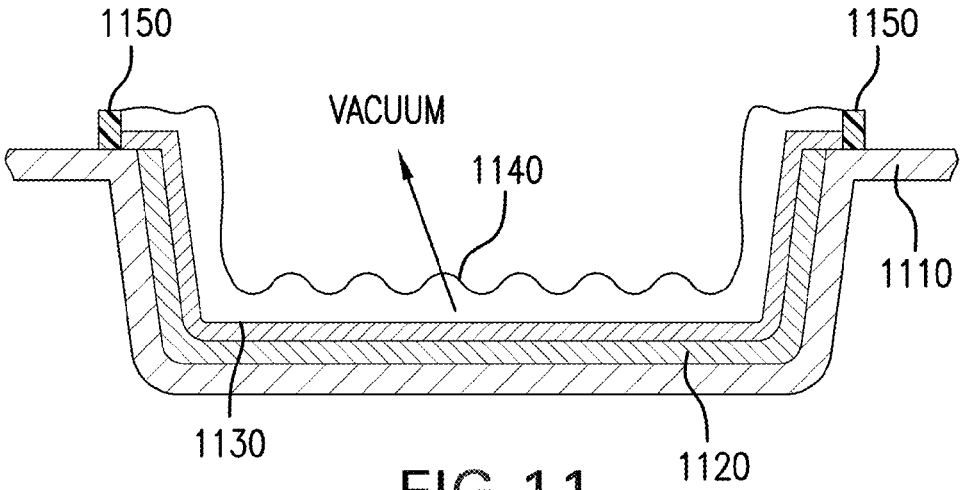
FIG. 11 is a cross-sectional view of an exemplary portion of a vehicle body of the present invention during assembly.

An exemplary illustration of the use of the film is shown in FIG. 11, which provides a cross-sectional view of an exemplary portion of a vehicle body of the present invention during assembly. As shown in FIG. 11, composite preform 1120 is stuck or adhered to plasma coated steel panel 1110 through the use of a spray adhesive as described above. A release ply 1130 may be used between composite preform 1120 and film 1140, which is sealed to plasma coated steel panel 1110 with seal tape 1150. As shown in FIG. 11, vacuum is applied to remove the air, thereby pulling composite preform 1120 to plasma coated steel panel 1110 to thereby form a composite adhered steel shell.

Once the composite preforms are stuck or adhered to the plasma coated steel panels, such as through the use of the film and vacuum process as shown in FIG. 11, the composite adhered steel shell that will form the vehicle body is placed in an oven, for example a vehicle paint oven, to heat the composite adhered steel shell in order to cure the epoxy resin in the composite preforms. The composite preforms need to be at a uniform temperature at the point the resin begins to flow, which is about 70° C. The temperature is then ramped up to about 130° C. over a period of time, depending upon the thickness of the plasma coated steel panels. The composite adhered steel shell remains in the oven for a dwell time of approximately 10-20 minutes, using a dwell or curing temperature of about 130° C. During this time, the resin runs into the plasma coat on the steel panels and forms a good bond between the composite preforms and the plasma coated steel panels. The composite adhered steel shell is removed after the dwell time is complete, and is allowed to cool. The sealant tape securing the film (for example, sealant tape 1150 illustrated in FIG. 11) is removed, and the remaining parts of the vehicle body can be assembled. The release ply and film may optionally be removed as well.

In another embodiment of the vehicle body assembly process of the present invention, the vehicle body or portion thereof may be painted while the composite adhered steel shell is in a vehicle paint oven to cure the composite preforms. In such an embodiment, a step of applying paint to the composite adhered steel shell can be carried out during the step of heating the composite adhered steel shell in an oven to cure the composite preforms.

To facilitate further assembly of the vehicle, inserts may be formed into the composite preforms to be used for attachment of, for example, DYNEEMA® panels or other parts on the interior of the vehicle. For example, the mold tool used to form a composite preform may include a hole into which is inserted a threaded stem such as a bolt. A nylon peg is placed over the threaded stem, and the composite preform is made with the nylon peg in place. Once the composite preform is complete, the nylon peg is removed. The nylon peg prevents the epoxy resin from gumming up and interfering with the threads, and can be readily removed without damaging the threads. Such a threaded stem or bolt could then be used to attach DYNEEMA® panels (such as innermost layer 117) on the inside of the vehicle, or, for example, provide a mounting for the steering column and wheel. Building in such attachment points when fabricating the composite preforms advantageously avoids having to cut through or weld to the plasma coated steel panels.

Embodiments of the present invention have been described for the purpose of illustration. Persons skilled in the art will recognize from this description that the described embodiments are not limiting, and may be practiced with modifications and alterations limited only by the spirit and scope of the appended claims which are intended to cover such modifications and alterations, so as to afford broad protection to the various embodiments of invention and their equivalents.

What is claimed as new and desired to be protected by Letters Patent of the United States is:

1. A multi-layer material for a vehicle body or hull, vessel hull, or aircraft fuselage, the multi-layer material providing blast and projectile impact protection, comprising:

an outermost layer comprising ceramic tiles, wherein said outermost layer includes an impact receiving side and an inner side, wherein a projectile impacting the multi-layer material proceeds from said impact receiving side of said outermost layer in an inward direction toward said inner side;

an innermost layer comprising ballistic material selected from the group consisting of aramid fibers, aromatic polyamide fibers and ultra-high molecular weight polyethylene, wherein said innermost layer is spaced apart inwardly from said inner side of said outermost layer;

a polymeric honeycomb layer;

a steel layer;

a composite layer comprising carbon fiber and glass fiber, wherein said composite layer has a non-uniform fiber fraction; and an air gap layer disposed between said innermost layer and said composite layer, wherein said steel layer is disposed between said composite layer and said polymeric honeycomb layer and said polymeric honeycomb layer is disposed between said steel layer and said inner side of said outermost layer.

2. The multi-layer material of claim 1, further comprising a plasma coating disposed on a side of said steel layer facing said composite layer.

3. The multi-layer material of claim 1, further comprising a plurality of ceramic pellets disposed within said polymeric honeycomb layer.

4. The multi-layer material of claim 1, wherein said polymeric honeycomb layer comprises polycarbonate.

5. The multi-layer material of claim 1, wherein said polymeric honeycomb layer comprises polyetherimide.

6. The multi-layer material of claim 1, wherein said steel layer comprises bainite.

7. The multi-layer material of claim 2, wherein said steel layer comprises bainite.

8. The multi-layer material of claim 1, further comprising a second air gap layer disposed between said steel layer and said polymeric honeycomb layer.

9. The multi-layer material of claim 1, wherein said composite layer further comprises an epoxy resin.

10. The multi-layer material of claim 1, wherein a weight ratio of carbon fiber to glass fiber in said composite layer is about 1:1.

11. The multi-layer material of claim 1, wherein a weight ratio of carbon fiber to glass fiber in said composite layer is about 1:1.5.

12. The multi-layer material of claim 10, wherein said glass fiber is S-2 glass fiber.

13. The multi-layer material of claim 1, wherein a cross-section of said multi-layer material is less than about 100 mm.

14. The multi-layer material of claim 13, wherein said outermost layer is about 12 mm.

15. The multi-layer material of claim 13, wherein said polymeric honeycomb layer is about 40 mm.

16. The multi-layer material of claim 13, wherein said steel layer is about 6 mm.

17. The multi-layer material of claim 13, wherein said composite layer is about 19 mm.

18. The multi-layer material of claim 13, wherein said air gap layer is about 12 mm.

19. The multi-layer material of claim 13, wherein said innermost layer is about 6 mm.

20. A vehicle, comprising:

a vehicle body that mitigates blast pressure and resists projectile penetration, said vehicle body comprising a steel layer;

a composite layer comprising carbon fiber and glass fiber, wherein said composite layer has a non-uniform fiber fraction;

an innermost layer comprising ballistic material selected from the group consisting of aramid fibers, aromatic polyamide fibers and ultra-high molecular weight polyethylene; and an air gap layer disposed between said innermost layer and said composite layer, wherein said composite layer is disposed between said steel layer and said innermost layer.

21. The vehicle of claim 20, further comprising a plasma coating disposed on a side of said steel layer facing said composite layer.

22. The vehicle of claim 20, wherein said steel layer comprises bainite.

23. The vehicle of claim 21, wherein said steel layer comprises bainite.

24. The vehicle of claim 20, wherein a weight ratio of carbon fiber to glass fiber in said composite layer is 1:1.

25. The vehicle of claim 20, wherein a weight ratio of carbon fiber to glass fiber in said composite layer is 1:1.5.

26. The vehicle of claim 24, wherein said glass fiber is S-2 glass fiber.

27. The vehicle of claim 20, further comprising:

an armor layer disposed on said vehicle body, said armor layer comprising an outermost layer comprising ceramic tiles, wherein said outermost layer includes an impact receiving side and an inner side, wherein a projectile impacting the vehicle proceeds from said impact receiving side of said outermost layer in an inward direction toward said inner side, and a polymeric honeycomb layer disposed between said steel layer and said inner side of said outermost layer.

28. The vehicle of claim 27, further comprising a plurality of wheels.

29. The vehicle of claim 27, further comprising a continuous track for movement of the vehicle.

30. The vehicle of claim 27, wherein said vehicle is of monocoque construction so that said vehicle body carries a majority of the stresses on the vehicle.

31. The vehicle of claim 20, further comprising a chassis, wherein said chassis is integral with said vehicle body.

32. The vehicle of claim 20, further comprising a plurality of trim items disposed in an interior of the vehicle, wherein at least one of said plurality of trim items is formed from said innermost layer.

33. The vehicle of claim 27, further comprising a plurality of trim items disposed in an interior of the vehicle, wherein at least one of said plurality of trim items is formed from said innermost layer.

34. The vehicle of claim 32, wherein said at least one of said plurality of trim items is an inside door panel.

35. The vehicle of claim 33, wherein said at least one of said plurality of trim items is an inside door panel.

36. The multi-layer material of claim 2, further comprising a plurality of ceramic pellets disposed within said polymeric honeycomb layer.

37. The multi-layer material of claim 13, further comprising a plurality of ceramic pellets disposed within said polymeric honeycomb layer.

38. The vehicle of claim 27, further comprising a plurality of ceramic pellets disposed within said polymeric honeycomb layer.

39. The vehicle of claim 30, further comprising a plurality of ceramic pellets disposed within said polymeric honeycomb layer.

40. A method of making a composite preform using a plurality of fiber types, comprising:

applying an epoxy to elongate lengths of at least one fiber type;

cutting the elongate lengths of the at least one fiber type and elongate lengths of others of the plurality of fiber types into shorter lengths of fiber to form a charge, wherein the applying step is carried out just prior to the cutting step;

removing at least a portion of air entrapped in the charge; and heating the charge to form a composite preform, wherein the composite preform has a non-uniform fiber fraction.

41. The method of claim 40, wherein the epoxy comprises magnetic particles.

42. The method of claim 40, wherein the step of removing at least a portion of air comprises applying a vacuum.

43. The method of claim 40, wherein the cutting step is carried out so that an arrangement of the shorter lengths of fiber in the charge is random.

44. The method of claim 40, wherein the step of removing at least a portion of air comprises compressing the charge.

45. The method of claim 40, wherein the plurality of fiber types comprises carbon fiber and glass fiber.

46. The method of claim 41, wherein the plurality of fiber types comprises carbon fiber and glass fiber.

47. The method of claim 46, wherein the applying step is carried out to apply the epoxy to elongate lengths of carbon fiber.

48. The method of claim 40, wherein the cutting step is carried out so at least a portion of the shorter lengths of fiber in the charge are aligned.

49. The method of claim 41, wherein the cutting step is carried out so at least a portion of the shorter lengths of fiber in the charge are aligned.

50. The method of claim 40, wherein the cutting step is carried out to form shorter lengths of fiber having multiple lengths.

51. The composite preform produced by the method of claim 40.

52. The composite preform produced by the method of claim 43.

53. The composite preform of claim 52, wherein the plurality of fiber types comprises carbon fiber and glass fiber.

54. The composite preform produced by the method of claim 49.

55. The composite preform of claim 54, wherein the magnetic particles are cobalt particles.

56. The method of claim 41, wherein the magnetic particles are cobalt particles.

57. The multi-layer material of claim 1, wherein said innermost layer comprises ultra-high molecular weight polyethylene.

58. The multi-layer material of claim 19, wherein said innermost layer comprises ultra-high molecular weight polyethylene.

59. The vehicle of claim 20, wherein said innermost layer comprises ultra-high molecular weight polyethylene.

60. A method for assembling a vehicle body or portion thereof, comprising:

applying a plasma coating to one side of each of a plurality of steel panels to form a plurality of plasma coated steel panels;

welding together less than all of the plurality of plasma coated steel panels to form a steel shell with an opening;

applying a contact adhesive to an interior surface of the steel shell;

contacting a plurality of composite preforms to the contact adhesive to thereby adhere the plurality of composite preforms to the interior surface of the steel shell, wherein each of the plurality of composite preforms comprises an epoxy and a plurality of fiber types and has a non-uniform fiber fraction;

inserting a film into the steel shell;

applying a vacuum to remove air between the film and the plurality of composite preforms to form a composite adhered steel shell; and heating the composite adhered steel shell in an oven to thereby cure the composite preforms.

61. The method of claim 60, further comprising:

applying paint to the composite adhered steel shell during the step of heating the composite adhered steel shell in the oven.

62. The method of claim 60, further comprising:

subsequent to the contacting step, welding the remaining one or more of the plurality of plasma coated steel panels to the steel shell to thereby close the opening.

63. The method of claim 60, wherein each of the plurality of composite preforms is produced by a method comprising:

applying an epoxy to elongate lengths of at least one fiber type;

cutting the elongate lengths of the at least one fiber type and elongate lengths of others of the plurality of fiber types into shorter lengths of fiber to form a charge, wherein the applying step is carried out just prior to the cutting step;

removing at least a portion of air entrapped in the charge; and heating the charge to form a composite preform, wherein the composite preform has a non-uniform fiber fraction.

64. The method of claim 61, wherein each of the plurality of composite preforms is produced by a method comprising:

applying an epoxy to elongate lengths of at least one fiber type;

cutting the elongate lengths of the at least one fiber type and elongate lengths of others of the plurality of fiber types into shorter lengths of fiber to form a charge, wherein the applying step is carried out just prior to the cutting step;

removing at least a portion of air entrapped in the charge; and heating the charge to form a composite preform, wherein the composite preform has a non-uniform fiber fraction.

* * * * *